US008453406B2

(12) United States Patent
Platt et al.

(10) Patent No.: US 8,453,406 B2
(45) Date of Patent: Jun. 4, 2013

(54) PRECAST COMPOSITE STRUCTURAL GIRDER AND FLOOR SYSTEM

(75) Inventors: David H. Platt, West Jordan, UT (US); John E. Charchenko, West Bountiful, UT (US); Daryl G. Hodgson, Lehi, UT (US); Russell J. Platt, Holladay, UT (US)

(73) Assignee: Plattforms, Inc., Holladay, UT (US)

( * ) Notice: Subject to any disclaimer, the term of this patent is extended or adjusted under 35 U.S.C. 154(b) by 237 days.

(21) Appl. No.: 12/773,718

(22) Filed: May 4, 2010

(65) Prior Publication Data

US 2011/0271618 A1 Nov. 10, 2011

(51) Int. Cl.
*E04B 5/10* (2006.01)
*E04B 5/14* (2006.01)

(52) U.S. Cl.
USPC ..... 52/414; 52/223.11; 52/223.8; 52/324; 52/334; 414/73.1

(58) Field of Classification Search
USPC ..... 52/745.05, 745.06, 223.9, 223.11, 52/223.8, 320, 324, 333, 340, 414, 323, 322, 52/334, 223.7; 14/73.1, 74.5
See application file for complete search history.

(56) References Cited

U.S. PATENT DOCUMENTS

| | | | | |
|---|---|---|---|---|
| 644,940 | A | 3/1900 | Orr | |
| 1,321,213 | A | 11/1919 | Johnson | |
| 1,863,258 | A * | 6/1932 | Tashjian | 52/336 |
| 1,891,763 | A | 12/1932 | Henderson | |
| 1,979,643 | A | 11/1934 | Sahlberg | |
| 2,016,616 | A | 10/1935 | Schaub | |
| 2,040,578 | A | 5/1936 | Venzie | |
| 2,171,338 | A | 8/1939 | Henderson | |
| 2,184,464 | A | 12/1939 | Myers | |
| 2,294,554 | A | 9/1942 | Henderson | |
| 2,297,952 | A | 10/1942 | Friberg | |
| 2,423,695 | A | 7/1947 | Falco | |
| 2,558,946 | A | 7/1951 | Bertram | |
| 2,592,634 | A | 4/1952 | Hart | |
| 2,675,695 | A | 4/1954 | Coff | |

(Continued)

FOREIGN PATENT DOCUMENTS

| | | |
|---|---|---|
| DE | 3837774 C1 | 5/1990 |
| EP | 0011555 A1 | 5/1980 |

(Continued)

OTHER PUBLICATIONS

Office Action dated Sep. 6, 2011 from U.S. Appl. No. 12/465,597, filed May 13, 2009 (12 pages).

(Continued)

*Primary Examiner* — Phi A
(74) *Attorney, Agent, or Firm* — Pate Peterson PLLC; Brett Peterson

(57) ABSTRACT

A composite floor panel includes a concrete floor deck having a side portion and an edge member secured to the side portion. The edge member is configured to be positioned in proximity to an adjacent edge member. The adjacent edge member is coupled to an adjacent concrete floor deck. The edge member is further configured to have a junction formed between the edge member and the adjacent edge member to define a channel. The edge member is further configured to have a binder material placed in the channel to form a joint between the concrete floor deck and the adjacent concrete floor deck.

24 Claims, 17 Drawing Sheets

U.S. PATENT DOCUMENTS

| | | | | | |
|---|---|---|---|---|---|
| 2,987,855 | A | | 6/1961 | Singleton et al. | |
| 3,091,313 | A | | 5/1963 | Colbath | |
| 3,103,025 | A | | 9/1963 | Gassner et al. | |
| 3,110,049 | A | * | 11/1963 | Nagin | 14/73 |
| 3,210,900 | A | | 10/1965 | Sattler | |
| 3,257,764 | A | | 6/1966 | Cripe | |
| 3,282,017 | A | | 11/1966 | Rothermel | |
| 3,385,015 | A | | 5/1968 | Hadley | |
| 3,550,332 | A | | 12/1970 | Wiesman | |
| 3,555,763 | A | | 1/1971 | Bloxom | |
| 3,567,816 | A | | 3/1971 | Embree | |
| 3,683,580 | A | * | 8/1972 | McManus | 52/334 |
| 3,728,835 | A | | 4/1973 | McManus | |
| 3,800,490 | A | | 4/1974 | Conte | |
| 3,841,597 | A | | 10/1974 | Butts et al. | |
| 3,842,558 | A | | 10/1974 | Scholz et al. | |
| 3,848,381 | A | | 11/1974 | Bloxom | |
| 3,885,369 | A | | 5/1975 | Ott | |
| 3,893,276 | A | | 7/1975 | Brown | |
| RE29,249 | E | | 6/1977 | Rice | |
| 4,115,971 | A | | 9/1978 | Varga | |
| 4,282,619 | A | | 8/1981 | Rooney | |
| 4,300,320 | A | | 11/1981 | Rooney | |
| 4,416,099 | A | | 11/1983 | Fiergolla et al. | |
| 4,442,648 | A | | 4/1984 | Reece | |
| 4,495,688 | A | | 1/1985 | Longpre et al. | |
| 4,529,051 | A | | 7/1985 | Stolz et al. | |
| 4,646,493 | A | | 3/1987 | Grossman | |
| 4,653,237 | A | * | 3/1987 | Taft | 52/335 |
| 4,700,519 | A | | 10/1987 | Person et al. | |
| 4,715,155 | A | | 12/1987 | Holtz | |
| 4,729,201 | A | | 3/1988 | Laurus | |
| 4,741,063 | A | | 5/1988 | Diana | |
| 4,741,138 | A | * | 5/1988 | Rongoe, Jr. | 52/334 |
| 4,781,006 | A | | 11/1988 | Haynes | |
| 4,912,794 | A | | 4/1990 | Thivans | |
| 4,972,537 | A | | 11/1990 | Slaw, Sr. | |
| 4,991,248 | A | | 2/1991 | Allen | |
| 4,993,094 | A | | 2/1991 | Muller | |
| 5,027,713 | A | | 7/1991 | Kindmann et al. | |
| 5,029,426 | A | | 7/1991 | Larson et al. | |
| 5,052,309 | A | | 10/1991 | Haselwander et al. | |
| 5,131,201 | A | | 7/1992 | Larson et al. | |
| 5,279,093 | A | * | 1/1994 | Mead | 52/834 |
| 5,317,854 | A | | 6/1994 | Yoshida et al. | |
| 5,373,675 | A | | 12/1994 | Ellison, Jr. | |
| 5,448,866 | A | | 9/1995 | Salto et al. | |
| 5,596,856 | A | | 1/1997 | Lebon | |
| 5,671,573 | A | | 9/1997 | Tadros et al. | |
| 5,678,373 | A | | 10/1997 | Franklin et al. | |
| 5,884,442 | A | | 3/1999 | Breault | |
| 5,924,254 | A | | 7/1999 | Franklin et al. | |
| 5,978,997 | A | | 11/1999 | Grossman | |
| 6,094,878 | A | | 8/2000 | Schluter | |
| 6,390,438 | B1 | | 5/2002 | McManus | |
| 6,474,029 | B1 | | 11/2002 | Cook et al. | |
| 6,494,008 | B1 | | 12/2002 | Bloem et al. | |
| 6,668,412 | B1 | | 12/2003 | Tadros et al. | |
| 6,668,507 | B2 | | 12/2003 | Blanchet | |
| 6,708,362 | B1 | | 3/2004 | Allen | |
| 6,709,192 | B2 | | 3/2004 | Smith | |
| 6,898,908 | B2 | | 5/2005 | Messenger et al. | |
| 6,915,615 | B2 | | 7/2005 | Won | |
| 7,010,890 | B2 | | 3/2006 | DeSutter | |
| 7,275,348 | B2 | | 10/2007 | DeSutter | |
| 7,448,170 | B2 | | 11/2008 | Skendz et al. | |
| 8,161,691 | B2 | | 4/2012 | Platt et al. | |
| 2003/0093961 | A1 | | 5/2003 | Grossman | |
| 2003/0182883 | A1 | | 10/2003 | Won | |
| 2006/0059835 | A1 | | 3/2006 | Werner | |
| 2006/0272267 | A1 | | 12/2006 | Mentado-Duran | |
| 2009/0100794 | A1 | | 4/2009 | Holmes et al. | |
| 2009/0288355 | A1 | | 11/2009 | Platt et al. | |
| 2010/0132283 | A1 | | 6/2010 | Platt et al. | |
| 2011/0196561 | A1 | | 8/2011 | Jorgensen | |
| 2011/0271617 | A1 | | 11/2011 | Platt et al. | |
| 2011/0271618 | A1 | | 11/2011 | Platt et al. | |

FOREIGN PATENT DOCUMENTS

| | | | |
|---|---|---|---|
| FR | 922480 | A | 6/1947 |
| GB | 1322754 | A | 7/1973 |
| JP | 8-060776 | | 3/1996 |
| JP | 11-236743 | | 8/1999 |
| JP | 2002-356913 | | 12/2002 |
| JP | 2010265689 | A | 11/2010 |
| WO | 02090660 | A1 | 11/2002 |

OTHER PUBLICATIONS

Office Action dated Oct. 28, 2011 from U.S. Appl. No. 12/773,714, filed May 4, 2010 (12 pages).
International Search Report dated Jul. 30, 2010 from PCT Application No. PCT/US09/064451 filed Nov. 13, 2009 (4 pages).
Written Opinion dated Jul. 30, 2010 from PCT Application No. PCT/US09/064451 filed Nov. 13, 2009 (7 pages).
ISR from PCT/US2011/026744, Dec. 13, 2011.
ISR from PCT/US2011/026751, Dec. 5, 2011.

* cited by examiner

PRECAST COMPOSITE STRUCTURAL GIRDER AND FLOOR SYSTEM

BACKGROUND

1. Field of the Invention

The present invention relates to precast composite floor systems.

2. Related Technology

Precast concrete construction is often used for commercial and industrial buildings, as well as some larger residential buildings such as apartment complexes. Precast construction has several advantages, such as more rapid erection of a building, good quality control, and allowing a majority of the building structural members to be precast. Conventional precast structures, however, suffer from several disadvantages, such as being heavy and requiring complex connections between precast members and to the rest of the building structure.

Currently, precast single tee and double tee panels are used for constructing floors. The precast single and double tees are typically eight feet wide and often between 25 and 40 feet long or longer. The single tee sections typically have a deck surface about 1.5 to 2 inches thick and a beam portion extending down from the deck surface along the longitudinal center of the deck. The beam is usually about 8 inches thick and about 24 inches tall.

Double tee panels usually have a deck surface which is about 2 inches thick and have two beams extending down from the deck. The beams are placed about four feet apart running down the length of the panel, and are about 6 inches thick and 24 inches tall. Often, after the single and double tee panels are installed, about 2 or 3 inches of concrete is placed on top of the panels.

Single and double tee panels can be heavy. Heavy floor panels can require heavier columns and beams (i.e., columns and beams with increased strength and structural integral) to support the floor panels and so on, increasing the weight of nearly every structural part of the building structure. Heavier structural elements often use more materials and are thus more expensive, require increased lateral and vertical support, and may limit the height of the building for a particular soil load bearing capacity.

SUMMARY OF THE INVENTION

A composite floor panel includes a concrete floor deck having a side portion and an edge member secured to the side portion. The edge member is configured to be positioned in proximity to an adjacent edge member. The adjacent edge member is coupled to an adjacent concrete floor deck. The edge member is further configured to have a junction formed between the edge member and the adjacent edge member to define a channel. The edge member is further configured to have a binder material placed in the channel to form a joint between the concrete floor deck and the adjacent concrete floor deck.

A method of forming a precast structural floor system may include precasting a first composite floor panel having a floor deck, precasting a second composite floor panel, securing a second edge angle of the first composite floor panel to a first edge angle of the second composite floor panel to define a channel therebetween, and placing a binder material in the channel.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

BRIEF DESCRIPTION OF THE DRAWINGS

Various embodiments of the present invention are shown and described in reference to the numbered drawings wherein.

Figure 1A:
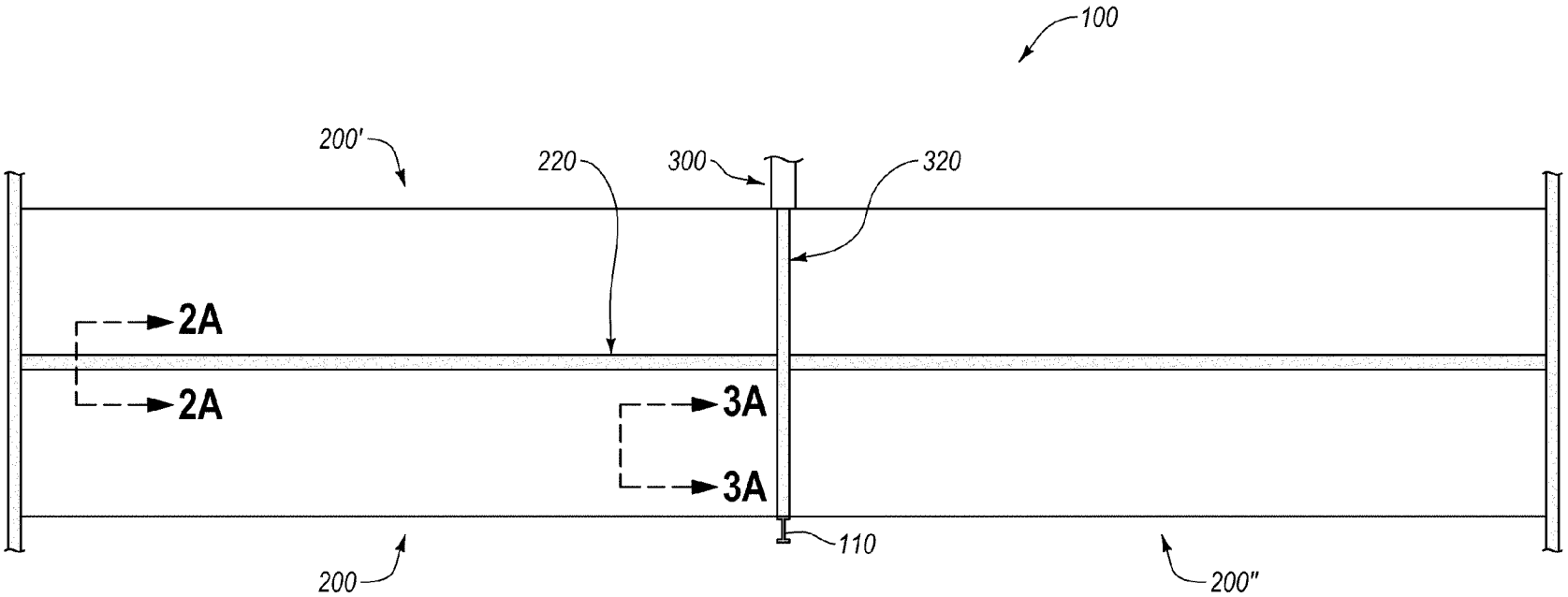
FIG. 1A illustrates a top view of an exemplary precast structural floor system according to one example.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

Exemplary precast structural flooring systems, composite flooring panels, composite girders, joints and methods for forming each will now be discussed in reference to the numerals provided therein so as to enable one skilled in the art to practice the present invention. The drawings and descriptions are exemplary of various aspects of the examples disclosed and are not intended to narrow the scope of the appended claims.

The examples disclosed below may reduce the weight of a flooring system compared to a conventional system. For example, a conventional concrete double tee system with similar spans and loading conditions would weigh approximately 100% more per square foot than examples disclosed herein. Other structural members such as concrete girders and concrete columns that are used with double tee systems are also much heavier than columns used with the present invention. Increased weight of the double tee floor system necessitates larger footings and foundation walls. This is restrictive for taller structures and for construction in areas with poor soil bearing capacity.

The vertical legs or walls of a double tee floor panel are solid and will not allow for passage of mechanical, plumbing or electrical through the tee, thereby increasing the floor to floor dimension because all of the utilities need to be run below the floor structure. Openings in the stem wall of the present system allow the mechanical, electrical and plumbing to pass through the structure, thereby eliminating the need to run these elements below the floor structure.

The present system also allows for greater flexibility in locating slab penetrations (openings through the floor slab) because the beams are spaced farther apart, typically 8 feet on center versus 4 or 5 feet for the legs of a double tee system.

Double tee systems are assembled by weld plates embedded in each component and must bear on concrete or masonry structures. The current system is bolted into a lighter steel structure which makes it possible to use in mid to high-rise construction.

Conventional steel and concrete composite construction also has several problems which are alleviated by the present invention. Conventional composite floor framing is very labor intensive on site. After installation of the columns for a conventionally framed floor, the rest of the materials for the conventional system are installed individually, and include the girders, joists, metal deck, nelson studs, reinforcing, edge enclosures, and poured concrete. This assembly takes much longer than the present invention due to the precast nature of the present system. With the present invention, tradesmen are able to occupy the floor to complete construction in a much shorter time frame which means shortened overall construction time.

Because of the way the calculations are performed for a conventional composite floor, the concrete that is below the top of the flute in the decking is not used in the composite section, but still contributes to the weight of the concrete in the building and the cost for that material. By precasting the floor panels, the present system has eliminated the need for the metal deck. This eliminates the material and the labor required to weld the steel deck in place.

In normal steel construction, the controlling factor over the size of the steel members is the necessity of the steel framing members to carry the full weight of the wet concrete without any of the concrete strength. In the present invention, the steel beams will be completely shored by the forms while the concrete is wet. This by itself reduces the size of the steel beam and eliminates the need for precambering the beam since the beams aren't required to support the weight of the wet concrete.

Additionally, in normal steel construction the beams are aligned so that the tops of the girders and joists are flush. This is done because the metal deck is placed on the joists and girders and the deck is used as a form for the concrete slab. When calculating the section properties for this system, the distance from the top of the steel beam to the middle of the concrete is one of the biggest factors. The present invention places a concrete stem wall between the steel beam and the concrete slab and removes the steel deck, thereby increasing the distance from the top of the steel beam to the centerline of the concrete slab and creating a composite section. As such, the load-bearing strength and span capabilities of the precast panel system are greatly increased. The present floor system eliminates a significant amount of steel and concrete material as compared to a conventional poured-in-place system.

In describing the precast structural floor system of the present invention, multiple views of the floor panel and girder are shown, including views of the parts thereof and cross-sectional views showing the internal construction thereof. Not every structure of the panel or girder is labeled or discussed with respect to every figure for clarity, but are understood to be part of the panel or girder.

Figure 1B:
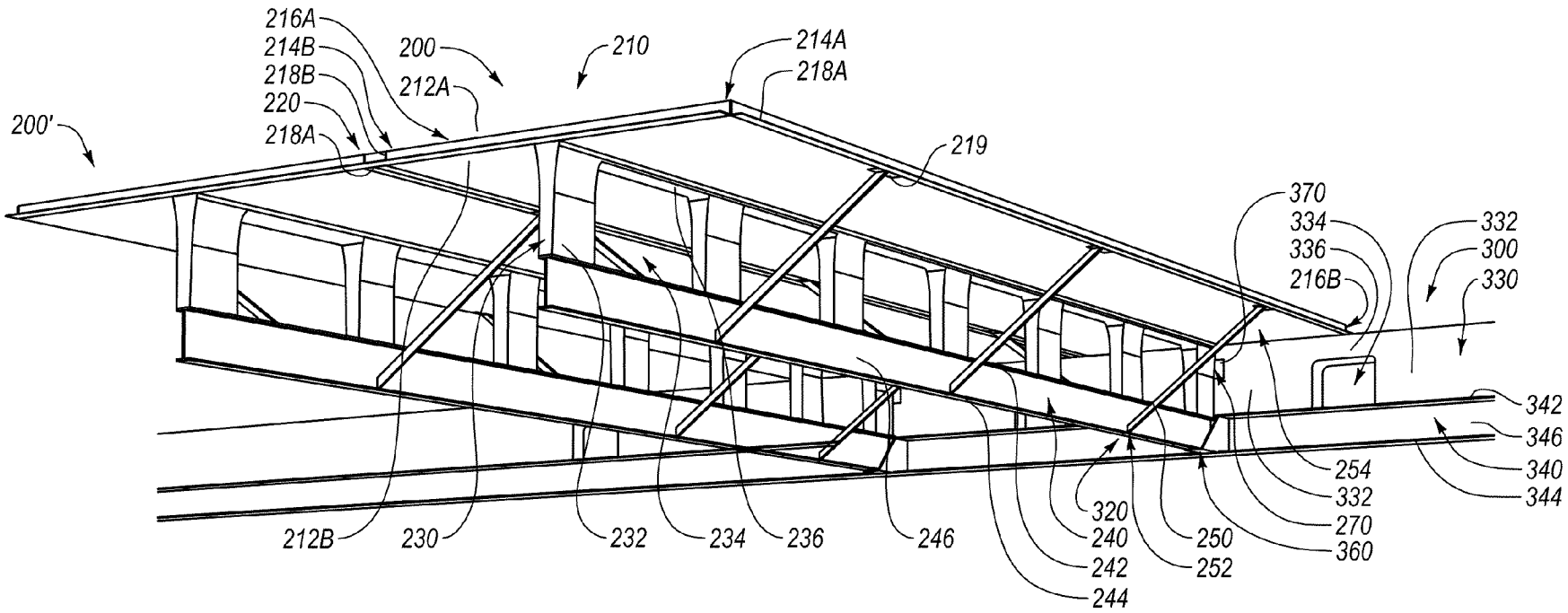
FIG. 1B illustrates a bottom perspective view of adjacent composite floor panels and an example composite girder according to one example.

FIGS. 1A and 1B illustrate a precast structural floor system 100 according to one example. By way of introduction, the configuration of various aspects of the precast structural floor system will be introduced below, followed by a discussion of the formation of those components. Accordingly, the configuration of exemplary composite floor panels will be discussed, followed by a discussion of the configuration of exemplary composite girders. The structure of joints formed between the composite floor panels will then be introduced as well as the structure of joints formed between composite floor panels and composite girders. Thereafter, the formation of a precast structural floor system will be described which includes a discussion of an exemplary method of forming a precast structural floor system, a discussion of an exemplary method of forming a composite girder, a discussion of an exemplary method of forming a joint between adjacent composite floor panels and finally a discussion of forming a joint between a composite floor panel and a composite girder.

As illustrated in FIGS. 1A and 1B, the example precast structural floor system 100 includes at least one composite floor panel, such as a composite floor panel 200, an adjacent composite floor panel 200', opposing composite floor panel 200", and a plurality of girders 300. FIG. 1B illustrates the composite floor panel 200 and the adjacent composite floor panel 200' resting on the composite girder 300 in which intervening composite girder have been omitted for clarity. The labels adjacent and opposing are provided for ease of reference only. It will be appreciated that the composite floor panels within the precast structural floor system 100 can have the same or different configurations than discussed herein. For ease of reference, similar components in the composite floor panel 200 will be labeled with the same reference numbers as corresponding components in the adjacent composite floor panel 200'. Accordingly, the composite floor panels 200, 200' are labeled for ease of reference only and the discussion of the composite floor panel 200 may be applicable to the composite floor panel 200' as well as other composite floor panels within the precast structural floor system 100.

As illustrated in FIG. 1B, the example composite floor panel 200 may generally include a concrete slab 210. A joint 220 may be formed between composite floor panels 200, 200' and between the concrete slab 210 of the composite floor panels 200, 200' in particular. The joint 220 will be discussed in more detail at an appropriate point after a more complete description of the configuration of the example composite floor panel 200.

As illustrated in FIG. 1B, in addition to the concrete slab 210, the composite floor panel 200 also includes a concrete stem wall 230, a steel panel beam 240, and a plurality of braces 250. In at least one example, the concrete slab 210 may be formed of a composite material, such as reinforced concrete, to thereby define upper and lower surfaces 212A, 212B, opposing sides 214A, 214B, and opposing ends 216A, 216B. One or more edge members 218A, 218B may also be embedded in the concrete slab 210 to extend from the opposing sides 214A, 214B respectively. As shown in 1B, each of the edge members 218A, 218B includes at least a generally horizontal portion extending transversely from the concrete slab 210. Though described as an edge member hereinafter, the edge members 218A, 218B may include only the horizontal portion shown. Further, as illustrated in FIG. 1B, each of the concrete slabs may also include weld plates 219 embedded in the concrete slab 210 adjacent the edge members 218A, 218B as desired. The example concrete slab 210 may be supported in any manner desired, one configuration of which will be described in more detail below.

In the illustrated example, the concrete slab 210 may be supported by, connected to, and/or integrally formed with the concrete stem wall 230. In particular, the stem wall 230 may extend downwardly and away from the lower surface 212B of the concrete slab 210. The stem wall 230 may include a plurality of stem supports 232 with openings 234 (also referred to as blockouts) defined in the concrete stem wall 230 between the stem supports 232. The openings 234 may reduce the amount of concrete utilized in the stem wall 230 relative to a continuous support, which in turn may reduce the dead load of the composite floor panel 200. In such a configuration, the stem supports 232 provide the structure to transfer shear loads between the concrete slab 210 and the steel panel beam 240. Further, the openings 234 may provide a convenient space to run HVAC ducts, piping and electrical conduit.

In at least one example, the concrete stem wall 230 also includes a plurality of ridges 236 that span the openings 234 between the stem supports 232. The ridges 236 may be in contact with and/or integrally formed with the lower surface 212B of the concrete slab 210 as desired. In at least one example, the ridges 236 may have a thickness that is approximately 50 percent of the thickness of the concrete slab 210. Accordingly, the concrete stem wall 230 may vary in thickness along the interface between the stem wall 230 and the concrete slab 210.

The concrete stem wall 230 is also connected to the steel panel beam 240. The concrete stem wall 230 may be connected to the steel panel beam 240 in any suitable manner, such as by welded studs and/or rebar. In the illustrated example, the steel panel beam 240 includes an I-Beam configuration. Accordingly, the steel panel beam 240 may include an upper flange 242, a lower flange 244, and a web 246 between the upper flange 242 and the lower flange 244. In the illustrated example, the upper flange 242 supports the stem supports 232.

The steel panel beam 240 may also serve as a base for the braces 250 to provide additional support for the I-Beam and reduce vibration in the concrete slab. In the illustrated example, the braces 250 may include a lower end 252 secured to the web 246 and/or the lower flange 244. An upper end 254 of the braces 250 may be secured to the weld plates 219 embedded in the concrete slab 210. Such a configuration can allow the steel panel beam 240 to support the concrete slab 210 by way of the concrete stem wall 230 as well as the braces 250. The concrete slab 210, the concrete stem wall 230, the openings 234, and the steel panel beam 240 can have any desired dimensions.

In at least one example, the concrete slab 210 is about eight feet wide, between about five and 40 feet long, and about three inches thick. The concrete stem wall 230 may be between, but not limited to, 12 and 36 inches in height. The openings 234 in the concrete stem wall 230 may be located adjacent the concrete stem wall 230, and may occupy the entire height of the concrete stem wall 230 as desired. Further, in at least one example, a 24 inch concrete stem wall 230 can be provided in which the openings 234 may be about 24 inches wide and 24 inches tall while the stem supports 232 may be approximately twelve inches wide and be placed between the openings. In at least one example, the steel panel beam 240 may be about twelve inches high overall. Further, the upper flange 242 and/or the lower flange 244 may be between about four and eight inches wide.

In general, when a beam supported at both ends is loaded the top half of the beam is under compression while the bottom half of the beam is under tension. Concrete has relatively high compressive strength but relatively low tensile strength, while steel has high tensile and compressive strength. Steel beams, however, may be expensive relative to concrete. In the example composite floor panel 200, the relative position of the concrete slab 210 causes the concrete slab 210 to be under compression while the relative position of the steel panel beam 240 may cause the steel panel beam 240 to be under tension. As a result, the configuration of materials of the composite floor panel 200 may utilize the best structural properties of concrete while optimizing the use of relatively expensive structural steel components.

Further, the configuration of the composite floor panel 200 allows them to be quickly installed at a building site. As will be discussed in more detail below, the composite floor panels 200 can be precast at a separate location as desired, brought to the building site, and lowered into place through the use of a crane. Once in place, the joint 220 may be formed between composite floor panels 200, 200' using binder materials, such as grout, reinforcing materials; such as welded wire mesh, anchors, shear studs and/or other reinforcing materials and fastening procedures such as welding or bolting.

As shown in FIG. 1B, a joint 320 may also be formed between the composite floor panel 200 and the girder 300. The configuration of the composite girder 300 will first be introduced in more detail, followed by discussion of the joint 220 between adjacent composite floor panels 200, 200' and a subsequent discussion of the joint 320 between composite floor panel 200 and the girder 300.

With continuing reference to FIG. 1B, the example composite girder 300 may generally include a concrete stem wall 330 and an I-Beam Configuration similar to that of the composite floor panel 200. In the illustrated example, the concrete stem wall 330 includes stem support 332 with openings 334 defined therein. Ridges 336 are formed above the openings 334. The ridges 336 may include a sufficient amount of continuous concrete (preferably between 33 and 50 percent of the height of the stem wall 330) so as to provide desired compression strength.

The concrete stem wall 330 can be coupled to or supported by the flange beam 340 in any desired manner. In the illustrated example, the flange beam 340 may include an upper flange 342, a lower flange 344, and a web 346 that extends between the upper flange 342 and the lower flange 344. The upper flange 342 may be configured to support the concrete stem wall 330.

A saddle 360 may be fastened to the flange beam 340 to provide support for the steel panel beam 240. Accordingly, the composite girder 300 is configured to provide support for the composite floor panels 200, 200'. The configuration and interaction of the saddle 360 will be described in more detail below in connection with the description of the joint 320 formed between the composite girder 300 and the composite floor panel 200 after a discussion of the joint 220 between adjacent composite floor panels 200, 200'.

Figure 2A:
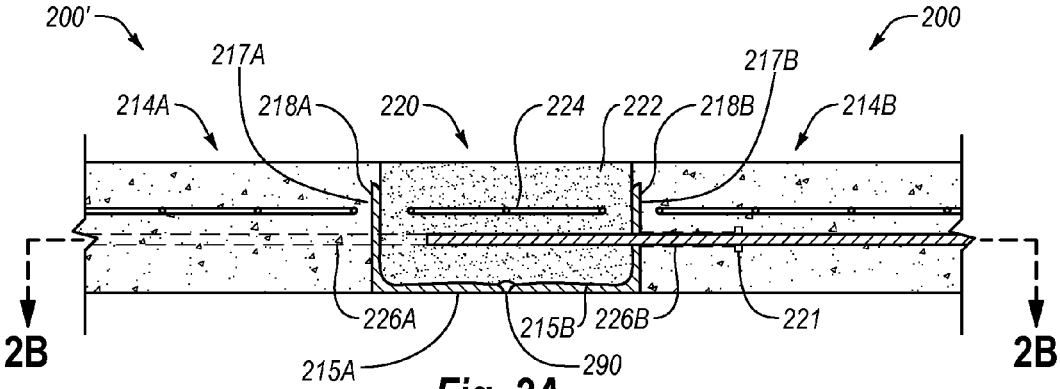
FIG. 2A illustrates a partial cross-sectional view of a joint between two of the adjacent composite floor panels taken along section 2A-2A of FIG. 1A.

The configuration of the example joint 220 will now be discussed in more detail. FIG. 2A illustrates a cross sectional view of adjacent composite floor panels 200, 200' taken along section 2A-2A of FIG. 1A. As illustrated in FIG. 2A, the joint 220 includes the edge member 218B associated with the composite floor panel 200 and the edge member 218A associated with the adjacent composite floor panel 200'. In particular, the edge members 218A, 218B include transverse portions 215A, 215B and lateral portions 217A, 217B. The transverse portions 215A, 215B are shown as being generally horizontal while the lateral portions 217A, 217B are shown as being generally vertical. It will be appreciated that the transverse portions 215A, 215B can extend away from the sides 214A, 214B at any desired angle relative to the lateral portions 217A, 217B. It will also be appreciated that the lateral portions 217A, 217B can be omitted as desired.

When a junction, such as a weld 290, is formed that connects the edge members 218A, 218B, and the transverse portions 215A, 215B in particular, a channel is formed between the edge members 218A, 218B. In the illustrated example, anchors 221 may be secured to the edge members 218A, 218B. The anchors 221 may also be embedded within the concrete slab 210. In at least one example, the anchors 221 are shear studs or other similar types of anchors. In the illustrated example, the edge members 218A, 218B are generally L-shaped to thereby define a generally vertical portion and a generally horizontal portion. It will be appreciated that other configurations are possible, including an inverted T-configuration or any other configuration desired.

The joint 220 also includes binder material 222, such as high strength and/or non-shrink grout. In the illustrated example, various reinforcements are embedded in the binder material 222. These reinforcements may include welded wire mesh 224 and/or reinforcements 226A, 226B.

In at least one example, the reinforcement 226A is embedded in the side 214A of the concrete slab 210 and extends through the edge member 218A into the binder material 222. Similarly, the reinforcement 226B may be anchored in the side 214B of the concrete slab 210 and extend through the edge member 218B into the binder material 222.

Figure 2B:
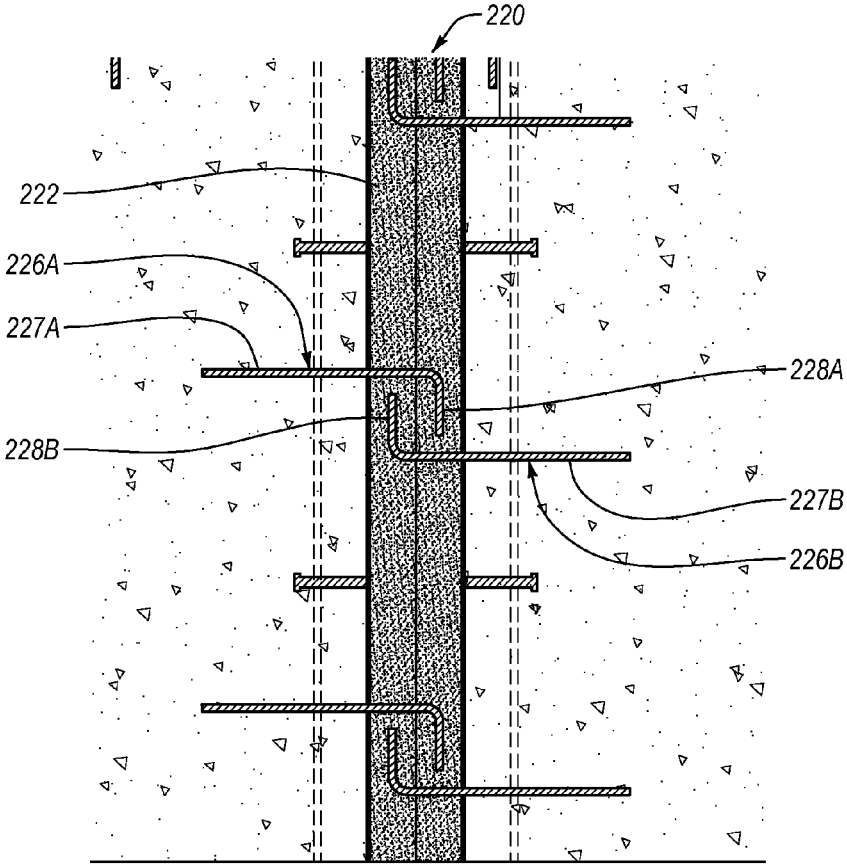
FIG. 2B illustrates a partial cross-sectional view of the joint of FIG. 2A between the adjacent composite floor panels taken along section 2B-2B of FIG. 2A.

FIG. 2B illustrates a further cross sectional view of the joint 220 taken along section 2B-2B of FIG. 2A. As illustrated in FIG. 2B, the reinforcements 226A, 226B may include first portions 227A, 227B and second portions 228A, 228B. The first portions 227A, 227B may be embedded in the composite floor panels 200' 200 and extend into the binder material 222 as described above. As shown in FIG. 2B, the second portions 228A, 228B may be disposed at an angle relative to the first portions 227A, 227B, thereby defining a bend therebetween.

In the illustrated example, the second portions 228A, 228B are generally oriented parallel to the edge members 218B, 218A respectively. Further, the second portions 228A, 228B may be oriented to face each other. In addition, the first portions 227A, 227B may extend sufficiently into the binder material 222 to result in overlap of the first portions 227A, 227B within the binder material 222. The configuration of the reinforcements 226A, 226B can allow for rapid formation of the joint 220 as the composite floor panels 200, 200' (FIG. 1B) are lowered into place on the composite girder 300 (FIG. 1B). An exemplary configuration of the interaction between the example composite floor panels 200, 200' and the girder 300 will first be introduced with reference to FIG. 1B. Thereafter, the example configuration shown in FIG. 1B will be discussed in more detail with reference to FIGS. 3A-3C.

As illustrated in FIG. 1B, a joint 320 may be formed between the composite floor panel 200 and the composite girder 300. The joint 320 may include several aspects. As illustrated in FIG. 1B, exemplary aspects of the joint 320 may include a saddle 360 secured to the flange beam 340, a girder joint plate 370 secured to the concrete stem wall 330, and a binder material 380 (FIG. 3C). By way of introduction, the joint 320 may be formed by placing the lower flange 244 of the steel panel beam 240 in the saddle 360, fastening the lower flange 244 to the saddle 360, fastening a panel joint plate 270 to the girder joint plate 370, and applying the binder material 380 (FIG. 3C), which can allow the joint 320 to be formed rapidly.

Figure 3A:
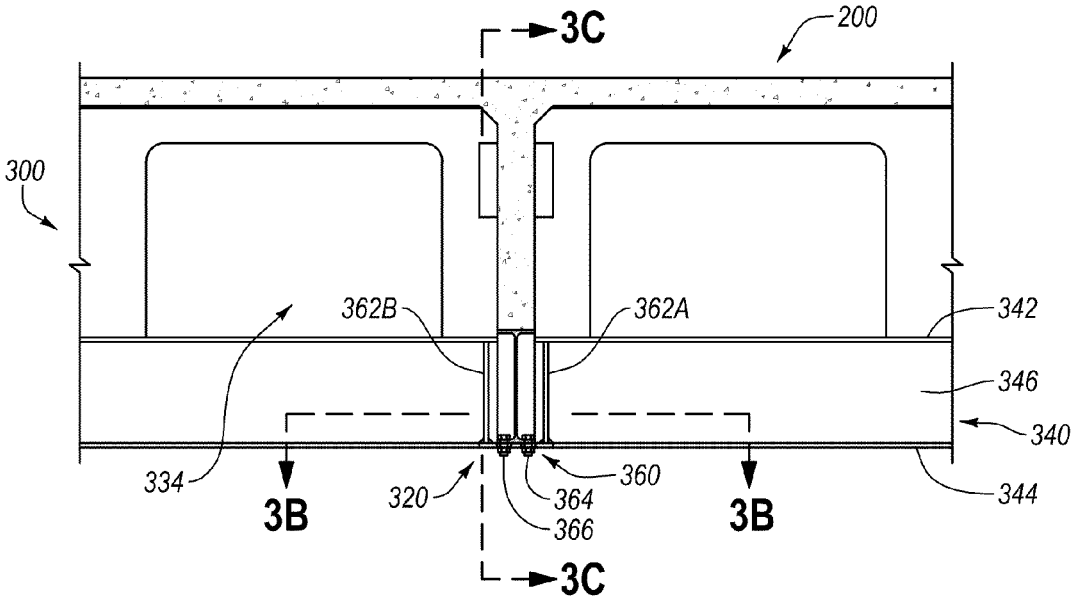
FIG. 3A illustrates a partial cross sectional view of an example joint between a composite floor panel and an example composite girder taken along section 3A-3A of FIG. 1A.
Figure 3B:
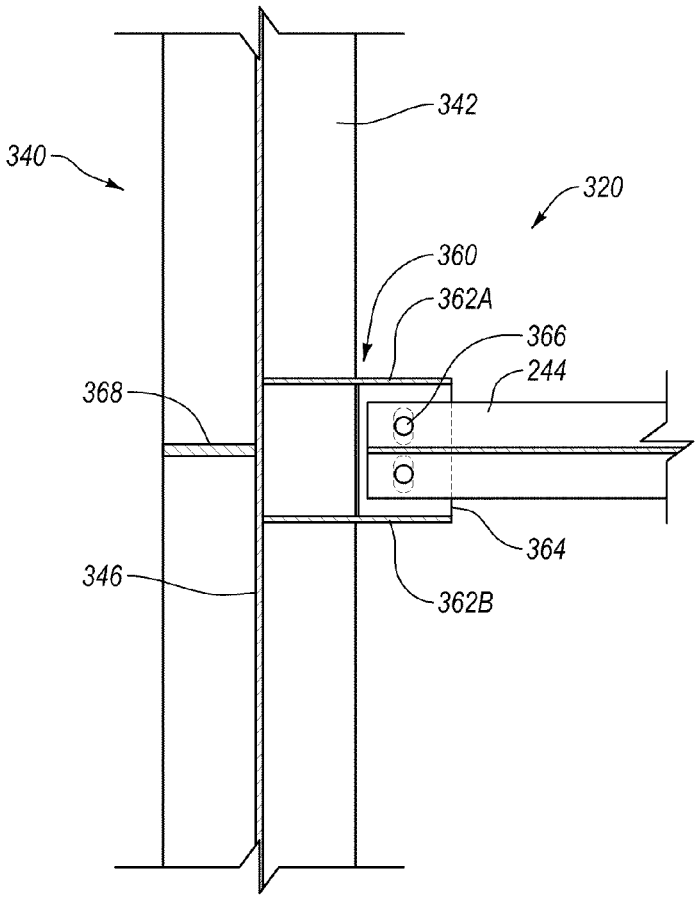
FIG. 3B illustrates a partial cross-sectional view of the joint of FIG. 3A taken along section 3B-3B of FIG. 3A.
Figure 3C:
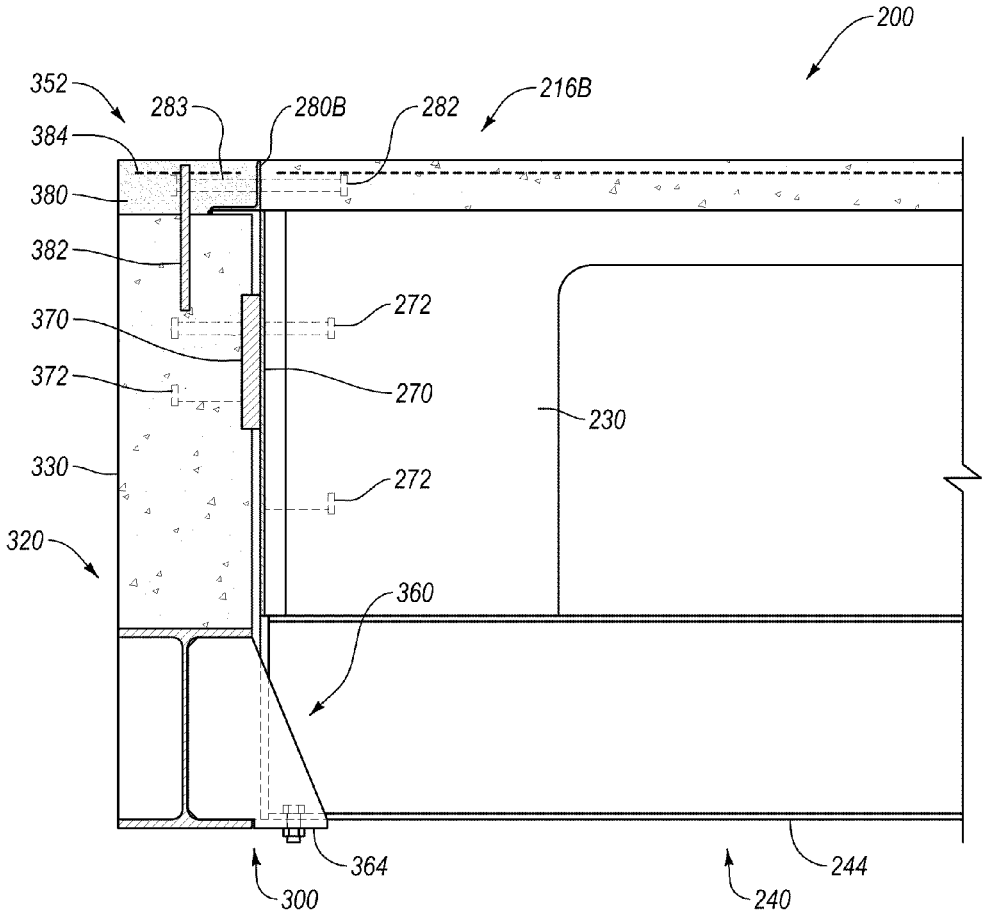
FIG. 3C illustrates a partial cross-sectional view of the joint of FIG. 3A taken along section 3C-3C of FIG. 3A.

FIG. 3A illustrates a partial cross-sectional view of the joint 320 taken along section 3A-3A of FIG. 1A. As illustrated in FIGS. 3A and 3B, the saddle 360 generally includes opposing side plates 362A, 362B and a bottom plate 364. The bottom plate 364 may be fastened to and extend between the opposing side plates 362A, 362B to define a recess configured to receive at least a portion of the steel panel beam 240.

As particularly shown in FIG. 3B, the lower flange 244 can be placed on the lower plate 364 of the saddle 360. The lower flange 244 can also be secured in place relative to the saddle 360. In at least one example, the lower flange 244 can be secured to the lower plate 364 by fasteners 366 that pass through both the lower flange 244 and the lower plate 364. Accordingly, one aspect of the joint 320 may include the securing of the steel panel beam 240 in place within the saddle 360.

FIG. 3C illustrates a partial cross-sectional view of the joint 320 taken along section 3C-3C of FIG. 3A. As illustrated in FIG. 3C, another aspect of the joint 320 includes securing the girder joint plate 370 to the panel joint plate 270. The example panel joint plate 270 may be secured to anchors 272, such as shear studs or other types of anchors. The anchors 272 may be embedded within the concrete stem wall 230, thereby securing the panel joint plate 270 to the composite floor panel 200. Similarly, the example girder joint plate 370 may be secured to anchors 372 embedded within the concrete stem wall 330, thereby securing the girder joint plate 370 to the girder 300. In at least one example, the anchors 372 are shear studs. The panel joint plate 270 can be secured to the girder joint plate 370 in any suitable manner, such as by welding, fasteners, and/or in any other manner.

Another aspect of the joint 320 is also shown in FIG. 3C. In particular, when the composite floor panel 200 is positioned on the composite girder 300, a recess 352 is defined between the composite floor panel 200 and the composite girder 300. Further, the second end 216B may include an edge angle 280B. The edge angle 280B may be secured to one or more anchors 282, 283. In particular, anchor 282 may be secured to the edge angle 280B and be embedded in the end 216B while anchor 283 may be secured to the edge angle 280B and extend into the recess 352. The anchors 282, 283 may be any desired type of anchor, such as shear studs. The opposing edge 216A (FIG. 1B) may also be similarly configured.

Reinforcements 382 may also be embedded within the concrete stem wall 330. The reinforcements 382 may extend into the recess 352. As a result, when the binder material 380 is placed in the recess 352, the anchors 283 as well as the reinforcements 382 may be embedded within the binder material 380. Further, additional reinforcements, such as welded wire mesh 384, may also be embedded within the binder material 380.

In at least one example, the binder material 380 may include a grout material, such as a non-shrink grout material. Accordingly, the joint 320 may be formed with several aspects that secure the composite floor panel 200 to the composite girder 300. The joint 320 between the composite floor panel 200 and the composite girder 300 as well as the joint 220 (FIG. 1A) between the composite floor panels 200, 200' can be rapidly formed. Exemplary methods for forming the composite floor panel 200, the composite girder 300, the joint 220, and the joint 320 will now be discussed.

Figure 4A:
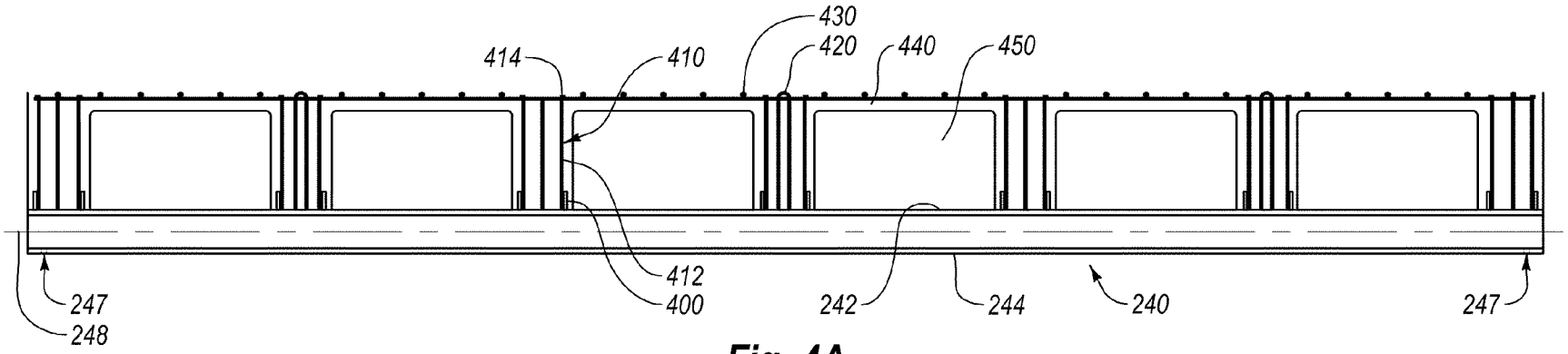
FIGS. 4A-4B illustrate various steps of an example method of forming a composite floor panel.

FIG. 4A illustrates various steps of an example method of forming a composite floor panel. As illustrated in FIG. 4A, the method can include cutting the steel panel beam 240 to an appropriate length per shop drawings approved by the engineer of record. Holes 247 for securing the steel panel beam 240 to the saddle 360 (FIGS. 3A-3B) may then be drilled into the lower flange 244 of the steel panel beam 240.

The steel panel beam 240 may then be placed upright so as to rest on the lower flange 244. Nelson studs 400 or similar connectors are then welded to the top side of the upper flange 242. Spacing of the Nelson studs 400 is per approved shop drawings at intervals less than or equal to the maximum spacing allowed by prevailing building codes. Vertical L-shaped reinforcing bars 410 may then be welded into place adjacent to the Nelson studs 400 which were previously welded to the upper flange 242 of the beam. The vertical reinforcing bars 410 may project upward from the upper flange 242 and then turn 90 degrees to thereby define short legs 412 and long legs 414. In such a configuration, the short legs 412 of the L-shaped reinforcing bars 410 run horizontally and perpendicular to a longitudinal axis 248 of the steel panel beam 240. The vertical reinforcing bars 410 are spaced according to the shop drawings approved by the engineer of record, typically with one vertical reinforcing bar 410 per every Nelson stud 400.

Lifting loops 420 made from reinforcing bar or other similar steel bar which have been bent into u-shapes may also be secured to the upper flange 242 of the steel panel beam 240 between the vertical reinforcing bars 410 where concrete will be poured to surround the lifting loops 420 and vertical reinforcing bars 410, leaving the tops of the lifting loops uncovered by concrete for lifting with a crane. The length of the lifting loops 420 may be approximately 0.25" less than the distance from the top side of the upper flange 242 to the top surface of the finished concrete slab 210 (FIG. 1B). Lifting loops 420 may be spaced at intervals determined by the overall length of the composite floor panel 200. In at least one example, three lifting loops 420 are used per finished composite floor panel 200 (FIG. 1B).

The assembled steel panel beam 240, with the vertical L-shaped reinforcing bar 410 and the lifting loops 420 secured thereto, is then moved to a floor-mounted jig (not shown) to hold the components steady while horizontal slab reinforcements 430, 440 are secured in place. In particular, the reinforcing bars 430 may be oriented parallel to the longitudinal axis 248 of the steel panel beam 240. The reinforcing bars 430 may be tied into place using standard tie wire to the horizontal legs 412 of the L-shaped reinforcing bars 410 or in any other suitable manner.

Reinforcing bars 440, which may be oriented perpendicular to the longitudinal axis 248 of the steel panel beam 240, may then be tied to the previously installed reinforcing bars 430. In at least one example, the reinforcing bars 430, 440 may be cut to a length about two inches shorter than the overall length or width of final concrete slab 210 (FIG. 1B) in which they are to be cast. Further, the reinforcing bars 430, 440 may be tied with tie wire at all intersections as desired. Additional reinforcing bars 430, 440 may then be tied to the other reinforcements as desired to form a desired grid.

Blockout forms 450 may be secured to the upper flange 242 at any desired point during the formation process. In at least one example, the blockout forms 450 may be formed of metallic material secured to the steel panel beam 240. In particular, the blockout forms 450 may be formed of steel plates that are bent to a desired shape. The blockout forms 450 may be secured to the steel panel beam 240 in any desired manner, such as by welding, magnets, fasteners such as bolt, and/or clips.

In another example, the blockout forms 450 may be made using a variety of materials, including but not limited to, styrene foam, rubber, wood and steel. In the case that the blockout forms 450 are formed of styrene foam blocks, the blockout forms 450 may be secured to the steel panel beam 240 by use of an adhesive, such as tape or glue. The blockout forms 450 may also be coated in form release oil or silicone to prevent the blockout forms 450 from bonding to the concrete of the concrete stem wall 230 (FIG. 1B) that is poured around it.

Figure 4B:
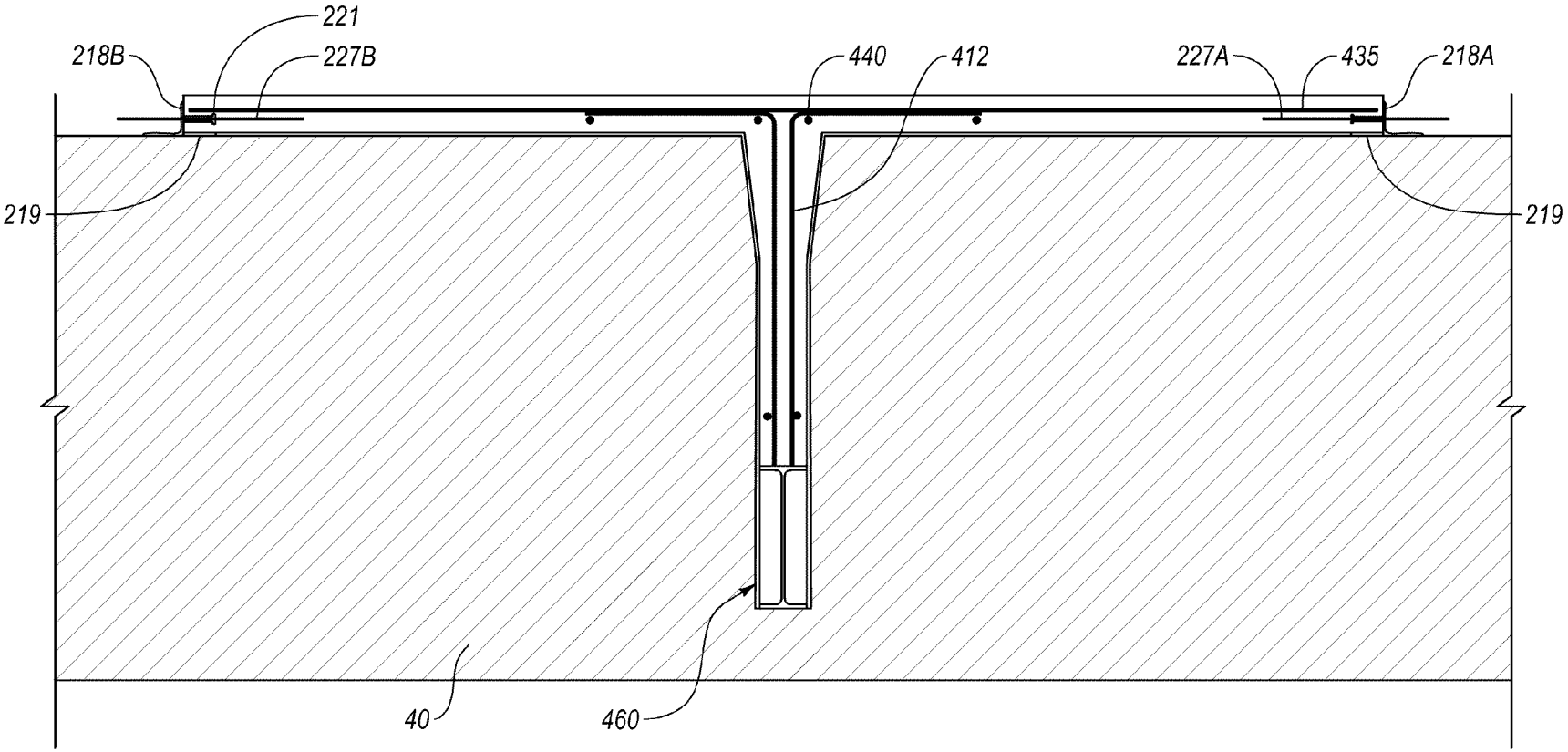

The resulting assembly may then be placed into a form 460, as illustrated in FIG. 4B. FIG. 4B illustrates a cross-sectional, view of the support surface 40 and the form 460 and an end view of the components within the form 460. It will be appreciated that the form 460 may be closed on either end.

The form 460 may be sprayed with form release oil prior to placing the components in the form 460 as desired. In at least one example, forms 460 may be formed of steel. The structure of the forms 460 can vary in length and width as well as construction so long as the inside shape of the form is the correct profile for the finished concrete portion of the composite floor panel 200 (FIG. 1B). The form 460 may be of sufficient strength to allow for numerous repetitive uses while maintaining the correct shape and configuration.

The edge members 218A, 218B, weld plates 219, reinforcements 227A, 227B, anchors 221, and other desired reinforcements are positioned in the form 460 and secured by tie wire or small bolts and held in position until the concrete has cured sufficiently. Though not shown, the other edge angles 280A, 280B, reinforcements 272, and anchors 282, 283 as well as the weld plate shown in FIG. 3C may also be placed into the form 460 and tied in place until the concrete has cured sufficiently. Welded wire mesh 435 may also be secured in place as desired.

Rebar chairs (not shown) may be placed under the reinforcing bars 430, 440 to maintain a desired separation between the lower surface 212B (FIG. 1B) of the concrete slab 210 and the underside of the reinforcing bars 430, 440. Rebar chairs may be spaced as desired, as determined by visual inspection once the beam assembly has been set in place and all the components described above have been tied securely to the reinforcing bars 430, 440. While one method of providing reinforcements has been described, it will be appreciated that any number of reinforcements assembled in any number of manners may also be provided.

Concrete (not shown) is placed in the forms in a manner to ensure that all reinforcing bars 430, 440 are sufficiently covered to thereby form the concrete slab 210 and concrete stem wall 230 (both seen in FIG. 1B). The upper surface of the concrete slab 210 may then be finished to industry standards for concrete floors. Thereafter, the concrete can be cured by any acceptable method as defined by precast concrete industry standards. Once the concrete has cured sufficiently the panel 200 (FIG. 1B) is lifted out of the forms by the lifting loops 420 attached to the steel panel beam 240. The panel 200 may then be set on a flat, level surface and held level by blocking, stands or other means acceptable to hold it level without putting excessive stresses on any one point in the panel 200.

The braces 250 shown in FIG. 1B may then be secured to the weld plates 219 and the upper flange 242 of the steel panel beam 240, such as by welding. The blockout forms 450 (FIG. 4A) may then be removed to thereby form the opening 234 previously discussed. Bolts or tie wire which were used to secure the components in place before the concrete was formed and which are projecting from the concrete slab 210 may be cut off flush with the lower surface 212B of the concrete slab 210.

Figure 5A:
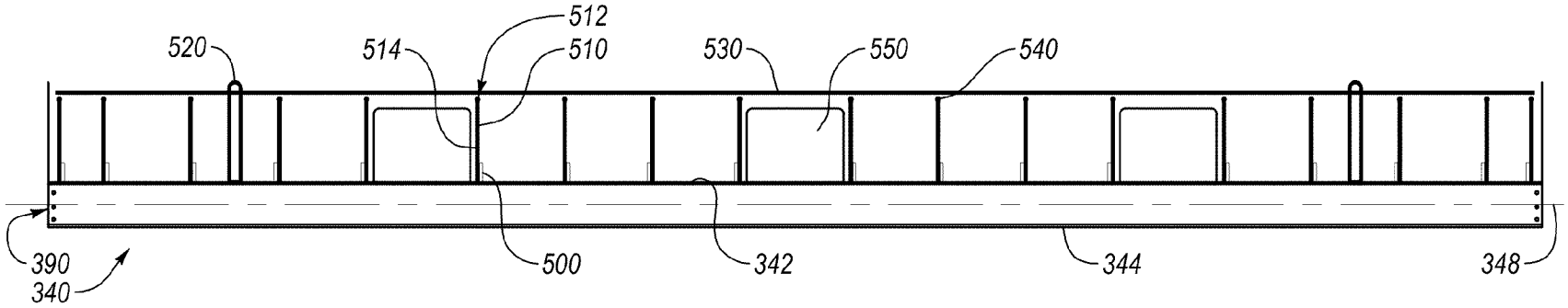
FIGS. 5A-5B illustrate various steps of an example method of forming a composite girder.
Figure 5B:
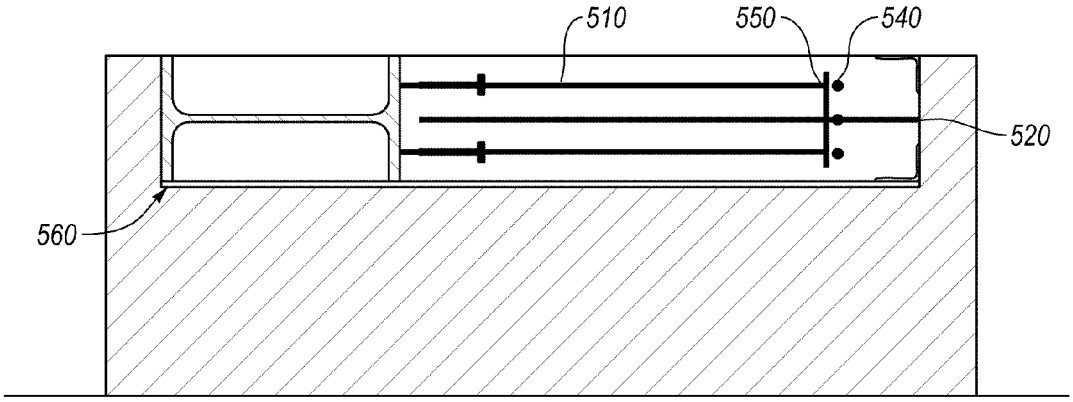

FIGS. 5A and 5B illustrate an exemplary method of forming a composite girder. As illustrated in FIG. 5A, the method may include cutting the flange beam 340 to an appropriate length per shop drawings approved by the engineer of record. Holes 390 used for connecting the flange beam 340 to columns (not shown) are then drilled into each end of the flange beam 340.

The flange beam 340 may then be oriented to rest on the lower flange 344. Nelson studs 500 or similar connectors may then be secured to an upper surface of the upper flange 342. Spacing of the Nelson studs 500 is per approved shop drawings at intervals less than or equal to the maximum spacing allowed by prevailing building codes. Vertical L-shaped reinforcing bars 510 may then secured to the upper flange 342 into place. In at least one example, the L-shaped reinforcing bars 510 are positioned adjacent to Nelson studs 500 which were previously secured to the upper flange 342 of the flange beam 340.

In at least one example, the L-shaped reinforcing bar 510 projects upward from the upper flange 342 of the composite girder 300 and then turns ninety degrees to project horizontally and perpendicular to the longitudinal axis 348 of the flange beam 340. As a result, the L-shaped reinforcing bars 510 include a short leg 512 and a long leg 514. The L-shaped reinforcing bars 510 may be spaced according to the shop drawings approved by the engineer of record, typically with one L-shaped reinforcing bar 510 per every Nelson stud 500.

Lifting loops 520, such as reinforcing bar which has been bent into a u-shape, are also secured to the upper flange 342 of the flange beam 340. The length of the lifting loops 520 may be approximately 0.25" less than the distance from an upper surface of the upper flange 342 of the beam to a top surface of the completed concrete stem wall 330 (FIG. 1B). The lifting loops 520 may be spaced at desired intervals determined by the overall length of the composite girder 300 (FIG. 1B). In at least one example, two or more lifting loops 520 may be used on any single composite girder 300 (FIG. 1B).

The flange beam 340 with the lifting loops 520 and the L-shaped reinforcing bars 510, is then moved to a floor-mounted jig (not shown) to hold it steady. Reinforcing bars 530, which may be oriented generally parallel to the longitudinal axis 348 of the flange beam 340, may be tied to the short legs 512 of the L-shaped reinforcing bars 510. Reinforcing bars 540, which may be oriented generally perpendicular to the longitudinal axis 348 of the flange beam 340, may then be positioned on the reinforcing bars 530 and tied into place. In at least one example, the reinforcing bars 530 may be tied in place using 16 gauge tie wire.

Blockout forms 550 may be secured to the upper flange 342 at any desired point during the formation process. In at least one example, the blockout forms 550 may be formed of metallic material secured to the flange beam 340. In particular, the blockout forms 550 may be formed of steel plates that are bent to a desired shape. The blockout forms 550 may be secured to the flange beam 340 in any desired manner, such as by welding, magnets, fasteners such as bolts, and/or clips.

In another example, the blockout forms 550 may be formed of a foam material that are secured to the upper flange 342 of the flange beam 340, such as by adhesives such as glue and/or tape. The flange beam 340 with the reinforcements described above are then placed into a form 560 as shown in FIG. 5B. Though not shown in FIG. 5B, the girder joint plate 370 and the anchor 372, as well as anchors 272 shown in FIG. 3C may also be placed in the forms and maintained in desired positions in any suitable manner.

Concrete is placed in the form 560 in a manner to ensure that all the reinforcing bars 510, 530, 540 are sufficiently covered, typically leaving the tops of the lifting loops 520 not covered in concrete. One or more of the surfaces may then be finished to industry standards for concrete floors. The resulting girder may be cured by industry accepted methods. Once the concrete has cured sufficiently the composite girder 300 is lifted out of the form 560 by the lifting loops 520.

The forms 560 may have any configuration. In at least one example, the form 560 are formed from a metallic material, such as steel. Further, the structure of the form 560 can have any inside shape to provide a desired profile for the finished composite girder 300. The forms may also be of sufficient strength to allow for numerous repetitive uses while maintaining the correct shape and configuration.

The saddles 360 described above (FIG. 1B) may be secured to the lower flange 344 of the flange beam 340 at any desired point during or after the formation of the composite girder 300. As illustrated in FIG. 3B, the saddle 360 may be secured to the flange beam 340. In the example shown in FIG. 3A, the opposing side plates 362A, 362B may be secured to the lower flange 344 and/or the web 346, such as by welding and/or fastening. The lower plate 364 of the saddle 360 may be secured to the opposing side plates 362A, 362B and/or the lower flange 344, such as by welding and/or fastening. A stiffener plate 368 may be secured to an opposing side of the flange beam 340 as desired. In the illustrated example, the stiffener plate 368 is secured to the lower flange 344, the web 346, and the upper flange 342 (not shown in FIG. 3B).

Once the composite girders 300 and the composite floor panels are completed, the precast structural floor system 100 as shown in FIG. 1A may be assembled. In at least one example method, the composite girders 300 may be positioned by a crane by way of cables or straps attached to the lifting loops 520 (FIG. 5A). In such an example, the crane may lift the composite girder 300 into place relative to a column 110. The composite girder 300 can then be secured in place. In particular, the flange beam 340 can be fastened to the column 110 through the use of fasteners passed through the column holes 390 (FIG. 5A). Welded connections can be specified by the engineer of record as desired.

Once the composite girders 300 are in place, the composite floor panels 200, 200', 200" may be installed. In at least one example, the composite floor panel 200 may be positioned by a crane via a cable secured to the lifting loops 420 (FIG. 4A). In particular, as shown in FIG. 3C, the composite floor panel 200 may be set into place such that the steel flange beam 240 is positioned within the saddle 360, the edge angles 280B, 280A (not shown in FIG. 3C) are attached to the concrete stem wall 330, and the panel joint plates 270 are proximate the girder joint plates 370. Any number of composite floor panels 200 can be placed on the composite girder 300. The joints 220 may then be formed between the composite panels 200, 200' and the joints 320 may be formed between the composite panels 200, 200" and the composite girder 300. The formation of the joints 220 between the composite floor panels 200, 200' will now be discussed.

As illustrated in FIG. 2A, the joint 220 may be formed by positioning the edge members 218A, 218B in proximity with one another and then securing the edge members 218A, 218B together. In the illustrated example, a weld 290 may be used, but is not required to join the edge members 218A, 218B. Once the edge members 218A, 218B are secured together, the binder material 222 may be added and the wire mesh 224 embedded in the binder material 222. The binder material 222 may then be cured to provide the resulting joint 220 shown in FIG. 2A. Accordingly, the joint 220 may be formed rapidly once composite panels 200, 200' are in place using the preformed composite floor panels 200.

Similarly, the joint 320 between the composite floor panel 200 and the composite girder 300 may also be formed rapidly. In particular, once the composite floor panel 200 is positioned relative to the composite girder 300 as described above and as shown in FIG. 3C, the joint 320 may be formed by securing the lower flange 244 of the steel panel beam 240 to the saddle 360, securing the panel joint plate 270 to the girder joint plate 370, and placing the binder material 380 on top of the concrete stem wall 330 and the edge angle 280B to cover the anchors 282, 283 and then placing the wire mesh 384 within the binder material 380. The resulting joint 320 can then be cured and finished as desired. Accordingly, the joint 320 may be rapidly formed once the composite panel 200 is in place.

While example joints 220 between composite floor panels 200 and between composite floor panels 200 and composite girder 300 have been described, it will be appreciated that other configurations are possible. For example, FIGS. 6A-6D illustrate additional exemplary joints 610, 620, 630, and 640 respectively. For ease of reference, the following elements are similar to those described above with reference to FIGS. 1A-5B.

Figure 6A:
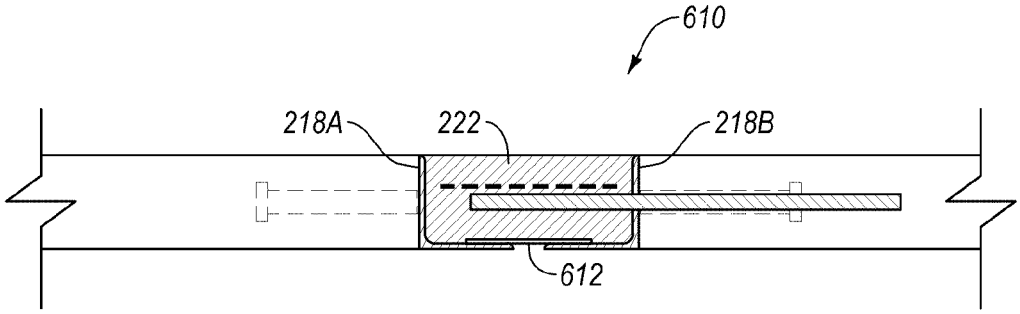
FIGS. 6A-6D illustrate alternative joints between composite floor panels according to several examples.
Figure 6B:
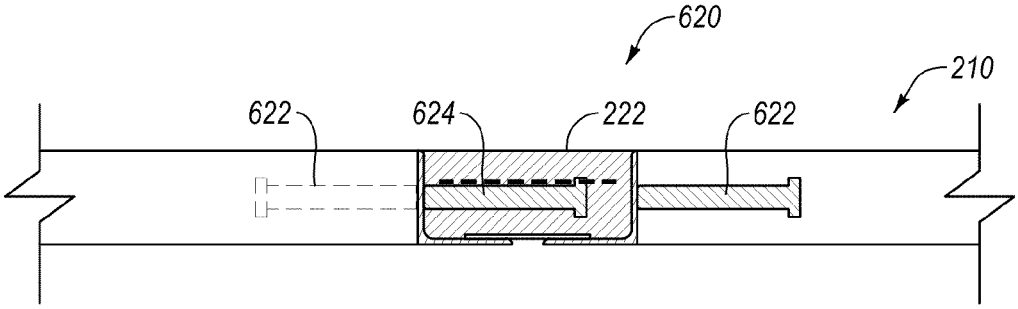
Figure 6C:
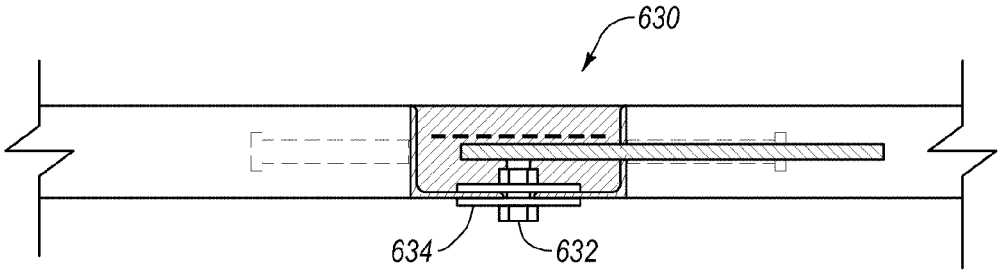
Figure 6D:
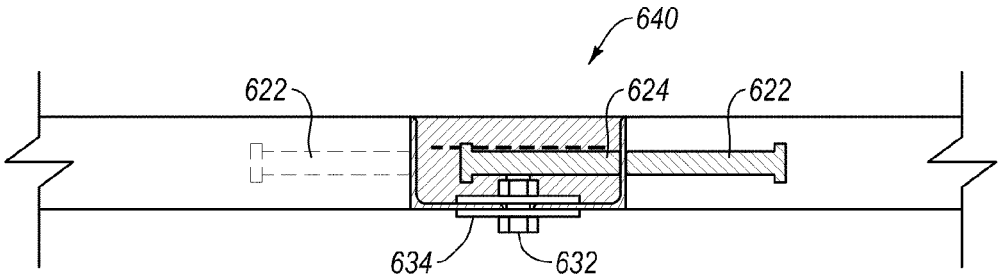

For example, in FIG. 6A the joint 610 includes a junction formed by a continuous pour stop 612 that is placed between the edge members 218A, 218B. FIG. 6B illustrates the joint 620 including edge members 218A, 218B that include shear studs 622, 624 secured to the edge members 218A, 218B. In particular, shear studs 622 extend into the concrete slab 210 while shear studs 624 extend into the binder material 222. FIG. 6C illustrates that the joint 630 may include a junction formed by high-strength thru-bolts 632 and square washers 634 that secure the edge members 218A, 218B. As illustrated in FIG. 6D, integral shear studs 622, 624 may also be used in conjunction with the thru-bolts 632 and square washer 634 as desired. Further, it will be appreciated that any number of reinforcements and fastening methods may be used in any number of combinations in addition to those described above.

Figure 7:
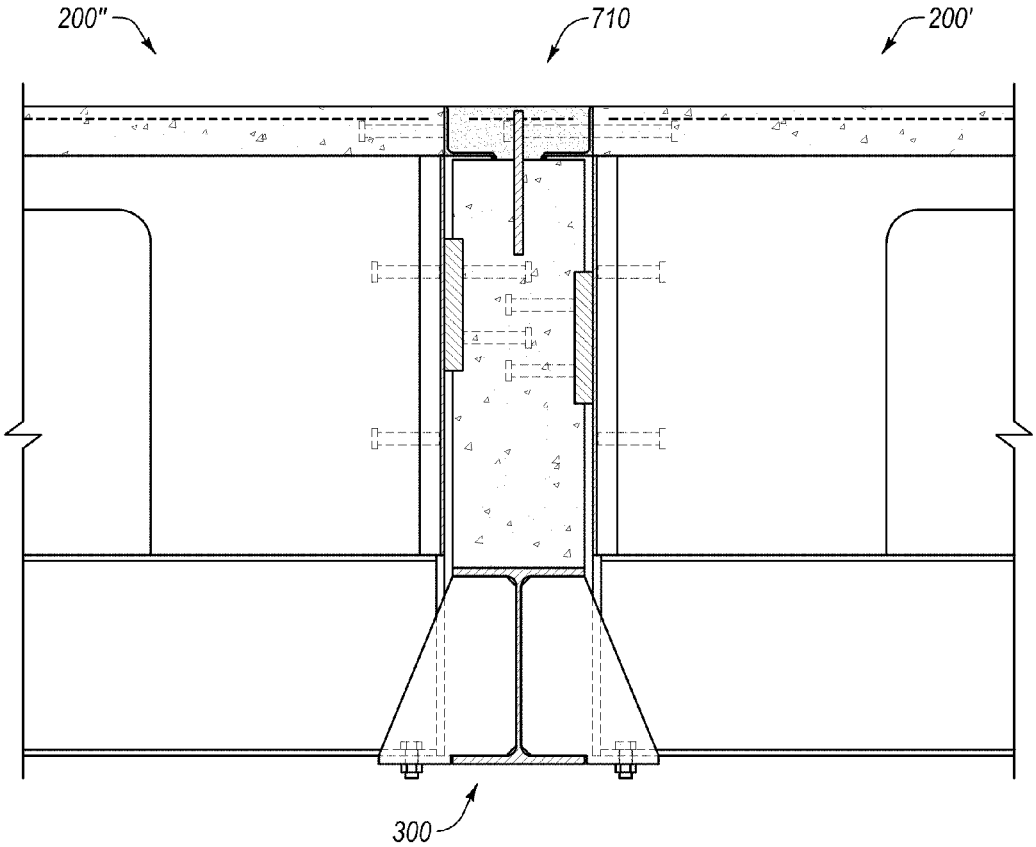
FIG. 7 illustrates a joint between opposing composite floor panels and a girder according to one example.

In addition, a joint 710 may be between the composite floor panel 200, the composite girder 300, and an opposing composite floor panel 200" in addition to between a composite floor panel 200 and the composite girder 300 as previously described, as shown in FIG. 7.

Figure 8A:
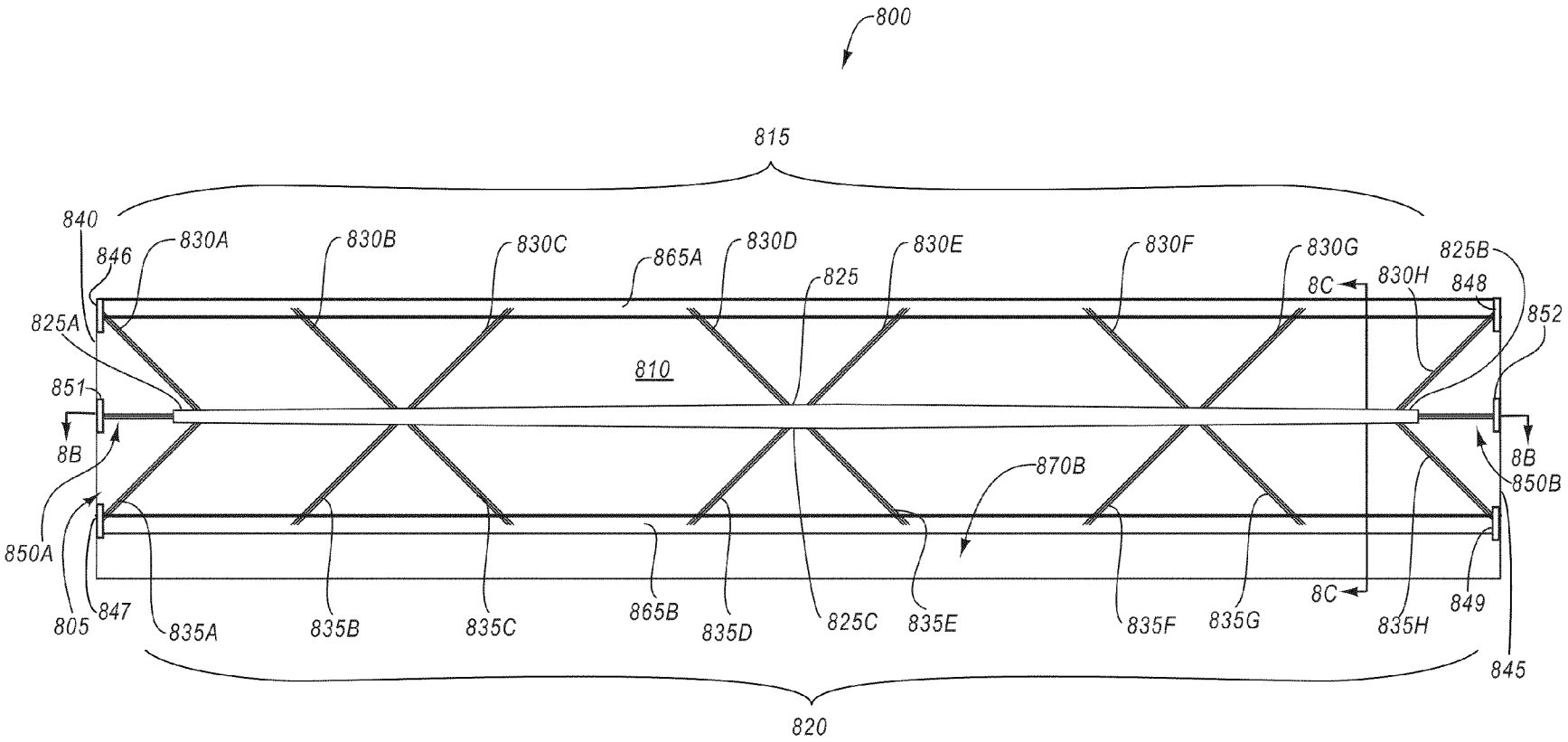
FIG. 8A is a bottom plan view of an exemplary embodiment of a composite floor panel.
Figure 8B:
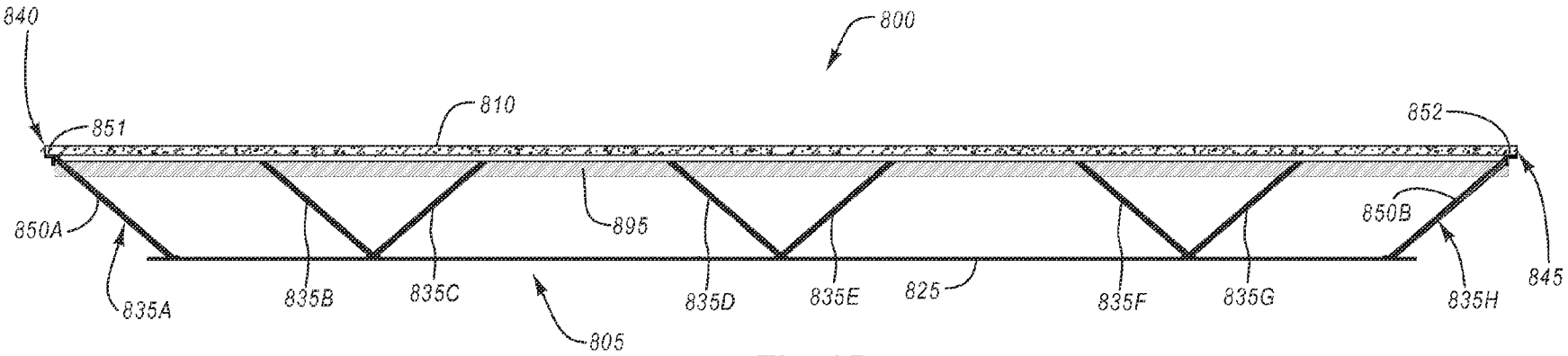
FIG. 8B illustrates a cross sectional view of the composite floor panel of FIG. 8A taken along section 8B-8B of FIG. 8A.
Figure 8C:
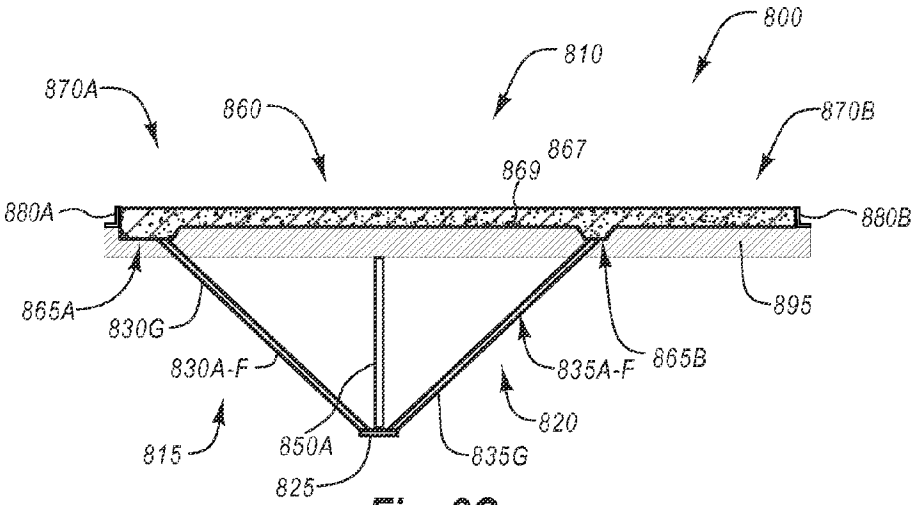
FIG. 8C illustrates a cross sectional view of the composite floor panel of FIG. 8A taken along section 8C-8C of FIG. 8A.

Further, FIGS. 8A-8C illustrate an alternative embodiment of a composite floor panel 800. In particular, FIG. 8A is a bottom plan view of the composite floor panel 800. The composite floor panel 800 can include a frame assembly 805 that is coupled to and supports a concrete portion 810. The configuration of the frame assembly 805 will first be introduced with reference to the concrete portion 810 generally, after which the configuration of the concrete portion 810 will be discussed in more detail. Thereafter, the structural relationships between the frame assembly 805 and the concrete portion 810 will be discussed in more detail.

As illustrated in FIG. 8A, the frame assembly 805 includes a first lateral set of support members 815, a second lateral set of support members 820, and a base plate 825 that is offset from the concrete portion 810. Each of the first and second sets of lateral support members 815, 820 can have a first end coupled to the concrete portion 810 and a second end coupled to the base plate 825. The base plate 825 could also be a steel tension member, steel bottom cord or steel bottom flange. The first set of lateral support members 815 can include a plurality of supports, such as supports 830A-830H that extend from the concrete portion 810 to the base plate 825.

In at least one example, the supports 830A-830H are oriented such that the supports 830A-830H are positioned in a common plane as shown more clearly in FIG. 8C. For example, FIG. 8C illustrates at least a portion of the first set of lateral support members 815 being aligned in at least one common plane with support 830G shown and supports 830A-830F positioned behind support 830G and thus hidden from view in FIG. 8C. Further, the supports 830A-830H can be secured to the base plate 825 in any suitable manner at any number of desired locations. In at least one example, the supports 830A-830H are secured to the base plate 825 in such a manner that connections between the supports 830A-830H and the base plate 825 lie in a line.

As also shown in FIG. 8A, the second set of lateral support members 820 can include a plurality of supports, such as supports 835A-835H. In the illustrated example, the supports 835A-835H can be oriented and positioned such that the supports 830A-830H lie in a common plane that is different than the common plane with respect to supports 830A-830H, as shown more clearly in FIG. 8C. For example, FIG. 8C illustrates at least a portion of the second set of lateral support members 820 being aligned in at least one plane with support 835G shown and supports 835A-835F positioned behind support 835G and thus hidden from view in FIG. 8C. In the illustrated example, the supports 835A-835H lie in a plane that is oriented at an angle to the plane in which supports 830A-830H lie.

The supports 835A-835H can be secured to the base plate 825 in any suitable manner at any number of desired locations. In at least one example, the supports 835A-835H are secured to the base plate 825 in such a manner that connections of the supports 835A-835H and the base plate 825 lie in a line on the base plate 825. In at least one example, the connections between the base plate 825 and the supports 835A-835H and the connections between the base plate 825 and the supports 830A-830H all lie in a common plane on the base plate 825. It will be appreciated that other configurations are also possible.

In addition, one or more of the supports 830A-830H of the first set of lateral support members 815 can be joined at substantially the same location on the base plate 825 as one or more of the supports 835A-835H of the second set of lateral support members 820. In particular, as shown in FIG. 8A, supports 830A and 835A can be secured to the base plate 825 at a common location. Similarly, supports 830B, 830C, 835B, and 835C can also be secured to the base plate 825 at another common location. Supports 830D, 830E, 835D, and 835E can also be secured to the base plate 825 at yet another common location, supports 830F, 830G, 835F, and 835G can be secured to the base plate 825 at yet another common location, and supports 830H and 835H can also be secured to the base plate 825 at still another common location.

As shown in FIG. 8A, the configuration and relative orientation of first and seconds sets of lateral support members 815, 820 can cause the frame assembly 805 to form a plurality of trusses with the concrete portion 810. For example, a group or web of trusses can be formed that include a truss formed by supports 830B and 830C and the concrete portion 810, another truss by supports 830C,835C and the concrete portion 810, yet another truss between supports 835C, 835B and the concrete portion 810, and still yet another truss between supports 835B and 830B. Similar groups or webs of trusses can also be formed with supports 830D, 830E, 835D, and 835E as well as with 830F, 830G, 835F, and 835G. Accordingly, supports 830B-830G cooperate with supports 835B-835G to form truss webs on an interior portion of the composite floor panel 800 relative to end edges 840, 845 of the concrete portion 810.

According to one embodiment of the invention, the first and second sets of lateral support members 815, 820 can be secured to the concrete portion 810 so as to have substantially similar distances between first ends of adjacent supports. For example, in one embodiment, the distance between the first end of support 830A and the first end of support 835A is substantially equal to the distance between the first end of support 830A and the first end of support 830B, which can be substantially equal to the distance between the first end of support 835A and the first end of support 835B, which can be substantially the same distance between the first end of support 830B and the first end of support 830C, and so forth. In another embodiment, the distance between the first end of support 830B and the first end of support 830C is substantially equal to the distance between the first end of support 835B and the first end of support 835C.

As also shown in FIG. 8A, supports 830A, 835A can extend toward the end edge 840 while supports 830H, 835H extend toward the end edge 845. In the illustrated example, a girder connection plate 846 is provided which can be secured to concrete portion 810 and to the first end of support 830A, and another girder connection plate 847 is provided which can be secured to concrete portion 810 and to the first end of support 835A. Similarly, another girder connection plate 848 is provided which can be secured to concrete portion 810 and to the first end of support 830H, and yet another girder connection plate 849 is provided which can be secured to concrete portion 810 and to the first end of support 835H.

In at least one example, the supports 830A-830H, 835A-835H, can be formed of a high-strength material, such as steel. For example, the supports 830A-830H, 835A-835H, can be formed from rolled steel angle members and/or heavy gauge bent shapes. The girder connection plates 846-849 can also be formed of a high-strength material, such as steel, including rolled steel angle members and/or heavy gauge bent shapes.

In at least one example, the base plate 825 can be a steel plate with a thickness of between about ⅜ inch and about ⅝ inch or more. Further, as shown in FIG. 8A, the base plate 825 can be shaped such that the base plate 825 is relatively narrower at end portions 825A, 825B and wider near a central portion 825C of the base plate 825. For example, the base plate 825 can have center width of between about five inches and about eight inches and end widths of between about four inches and about six inches. Such a configuration can provide relatively more material, such as steel, near the center of the composite floor panel 800 thereby increasing the section modulus and the moment of inertia at the center of the span where the greater capacity may be desirable, which in turn can allow for better performance for a given amount of material. In other examples, the base plate 825 can have a constant width or can have a relatively narrower central portion 825C than at end portions 825A, 825B. Accordingly, the base plate 825 can be configured as desired to provide a base for the supports 830A-830H, 835A-835H. The base plate 825 can also provide a base for additional supports.

FIG. 8B illustrates a cross sectional view of the composite floor panel 800 taken along section 8B-8B of FIG. 8A. As shown in FIG. 8B, the frame assembly 805 also includes end supports 850A, 850B coupled at a first end to the concrete portion 810 and coupled at a second end to the base plate 825. In the example shown in FIG. 8B, the end supports 850A, 850B can extend from the concrete portion 810 to the base plate 825. According to one embodiment, end support 850A can be positioned relative to base plate 825 and concrete portion 810 such that support 835A is positioned directly behind end support 850A as illustrated. In this orientation, end support 850A and support 835A, and likewise support 830A, can all share a common plane. Similarly, end support 850B and supports 835H, 830H can be aligned and thus share a common plane, as partially illustrated in FIG. 8B.

As shown in the illustrated embodiment, a girder connection plate 851 is provided which can be secured to end support 850A, and another girder connection plate 852 is provided which can be secured to a similar end support 850B positioned on the opposing end of the composite floor panel 800. In the illustrated example, the girder connection plate 851 is positioned beneath the end edge 840 of the concrete portion while girder connection 852 is positioned beneath the opposing end edge 845 of the concrete portion 810. Such configuration can allow the girder connection plates 851, 852 to thereby support opposing ends of the concrete portion 810. Referring again briefly to FIG. 8A, girder connection plates 846-849 can be secured to concrete portion 810 in a similar manner such that the girder connection plates 846-849 are positioned beneath the corresponding end edges 840, 845.

Support members 815 can be positioned in a corresponding manner with the position of support members 820, such that adjacent supports can share a common plane. For example, FIG. 8B illustrates support members 820 being connected to base plate 825 and extending toward concrete portion 810 at an angle with respect to base plate 825. Support members 820 can have a corresponding angle with respect to base plate 825. According to one embodiment, support 830A and support 835A have a substantially similar angle from the base plate 825 such that support 830A and support 835A share a common plane. Similarly, end support 850A can have a substantially similar angle from the base plate 825 as support 830A and support 835A, thus rendering supports 830A, 835A and end support 850A to be substantially aligned in a common plane. Similarly, support 830B can share a common plane with support 835B as a result of a substantially similar angle between support 830B and base plate 825 and between support 835B and base plate 825. Likewise, supports 830C, 835C can share a common plane, supports 830D, 835D can share a common plane, supports 830E, 835E can share a common plane, supports 830F, 835F can share a common plane, supports 830G, 835G can share a common plane, and supports 830H, 835H and end support 850B can share a common plane, each resulting from a similar angle between corresponding supports and the base plate 825.

FIG. 8C is a cross sectional view of the composite floor panel 800 taken along section 8C-8C of FIG. 8A and illustrates the structure of the concrete portion 810 in more detail. As illustrated in FIG. 8C, the concrete portion 810 generally includes a concrete slab 860, a first beam portion 865A, and a second beam portion 865B. The concrete slab 860 shown includes a generally planar top surface 867, a first lateral portion 870A and a second lateral portion 870B. In the illustrated example, an edge angle 880A is embedded in the first lateral portion 870A while another edge angle 880B is embedded in the second lateral portion 870B.

As shown in FIG. 8C, the first beam portion 865A and the second beam portion 865B extend downwardly and away from the concrete slab 860. In particular, the first beam portion 865A and the second beam portion 865B can be integrally formed with the concrete slab 860. Further, the first beam portion 865A and the second beam portion 865B can extend longitudinally along the length of the composite floor panel 800. In at least one example, a center of the first beam portion 865A and a center of the second beam portion 865B can be separated by a distance of between about four feet and about five feet or more, but preferably the spacing between the first beam portion 865A and the second beam portion 865B is approximately five feet. The first and second beam portions 865A, 865B can have a width of between about four inches and about eight inches and a height of between about six inches and about eight inches. Accordingly, the first beam portion 865A and the second beam portion 865B can be thicker than the rest of the concrete portion 810, including the concrete slab 860. The increased thickness of the first and second beam portions 865A, 865B can allow the first and second beam portions 865A, 865B to provide additional support for the remainder of the concrete portion 810. In at least one example, the frame assembly 805 is coupled to the concrete portion 810 by way of the first and second beam portions 865A, 865B, as will be described in more detail below.

Referring again to FIG. 8A, the first set of lateral support members 815 is coupled to the concrete portion 810 by way of the first beam portion 865A and the second set of lateral support members 820 is coupled to the concrete portion 810 by way of the second beam portion 865B. In particular, supports 830A-830H can couple to the first beam portion 865A and supports 835A-835H can couple to the second beam portion 865B. According to one embodiment, reinforcements, such as plates, rebar, anchors, and/or any other desired reinforcements can be placed within the concrete portion 810 to anchor the supports 830A-830H, 835A-835H, 850A-850B to the concrete portion 810 (collectively shown in FIGS. 8A-8C). As also shown collectively in FIGS. 8A-8C, supports 830A-830H, 835A-835H, 850A-850B can space the base plate 825 at a distance of between about four and five feet from a bottom surface 869 (best seen in FIG. 8C) of the concrete slab 860. As will be appreciated, supports 815, 820 can be modified to offset base plate 825 from concrete slab 860 a desired distance.

As shown particularly in FIGS. 8B and 8C, the composite floor panel 800 can also include a layer of material 895 to facilitate, among other things, formation of the concrete portion 810 as well as provide an insulation layer to dampen sound and/or reduce unwanted transfer of heat. In one embodiment, the layer of material 895 is a foam insulation form. Foam insulation form 895 was omitted from FIG. 8A to focus on the configuration of the frame assembly 805. It will be appreciated that the foam insulation form 895 can be an integral part of the composite floor panel 800 that abuts the concrete portion 810 shown in FIG. 8A.

In at least one example, the foam insulation form 895 can have a shape that is the negative or inverse of the concrete portion 810, including any desired part of the concrete slab 860 and/or the first and second beam portions 865A, 865B. Such a configuration can also provide a layer of floor insulation for both sound and temperature. Further, the foam insulation form 895 can also be used to house and otherwise preinstall a radiant floor heating and cooling system as desired. The foam insulation form 895 can be provided separately or can be used during the formation of the concrete slab 860 and the first and second beam portions 865A, 865B. One exemplary method of forming the composite floor panel 800 will now be discussed in more detail. Though various steps will be described in an exemplary order, it will be appreciated that the steps described below can be performed in a different order and some steps can be omitted entirely as appropriate or desired. Further, steps can be combined and/or split as desired.

Referring collectively to FIGS. 8A-8C, forming the composite floor panel 800 can include securing the second ends of supports 815, 820 and end supports 850A, 850B to the base plate 825, forming a concrete portion 810 and securing the first ends of supports 815, 820 and end supports 850A, 850B to the concrete portion 810. Supports 815, 820 and end supports 850A, 850B can be secured to base plate 825 by various securing methods, such as welding or through a traditional fastener such as a threaded coupling (i.e. bolt).

After supports 815, 820 and end supports 850A, 850B are secured to base plate 825, the foam insulation form 895 is then positioned relative to the supports 830A-830H, 835A-835H, 850A, 850B. The foam insulation form 895 can be supported in any suitable manner to maintain the foam insulation form 895 at a desired position and orientation relative to the base plate 825 and the supports 830A-830H, 835A-835H, 850A-850B.

Though not shown, reinforcements such as nelson studs, reinforcing rebar, shear studs, and any other reinforcement and/or intermediate supports can be positioned as desired relative to the foam insulation form 895. The reinforcements and/or intermediate members can be secured to each other and maintained in their position relative to the foam insulation form 895 in any manner desired, including through the use of wire, rebar chairs, and/or any other components as desired. In at least one example, lifting loops can also be provided as desired. Such reinforcements can also be used to tie the first ends of supports 815, 820, 850A, 850B together or to simply position the first ends of supports 815, 820, 850A, 850B in appropriate positions with respect to each other.

In one embodiment, securing the first ends of the supports 815, 820, 850A, 850B to the concrete portion 810 can include forming a beam around at least a portion of the first end of a support. In an alternative embodiment, securing the first end of a support to the concrete portion can include securing at least a portion of the first end of the support to a reinforcement member, such as rebar or a metal plate or some other type of fixture designed to be enclosed within the beam. In this manner, the support is coupled or otherwise connected to the beam and ultimately to the concrete portion.

Thereafter, the first and second beam portions 865A, 865B and at least a portion of the concrete slab 860 can be formed by pouring concrete into the foam insulation form 895. Thereafter, the concrete can be cured and the composite floor panel 800 can be ready for assembly with other composite floor panels 200 to form a precast structural floor system 900 (FIGS. 9A-9B), as will be described in more detail below.

Figure 9A:
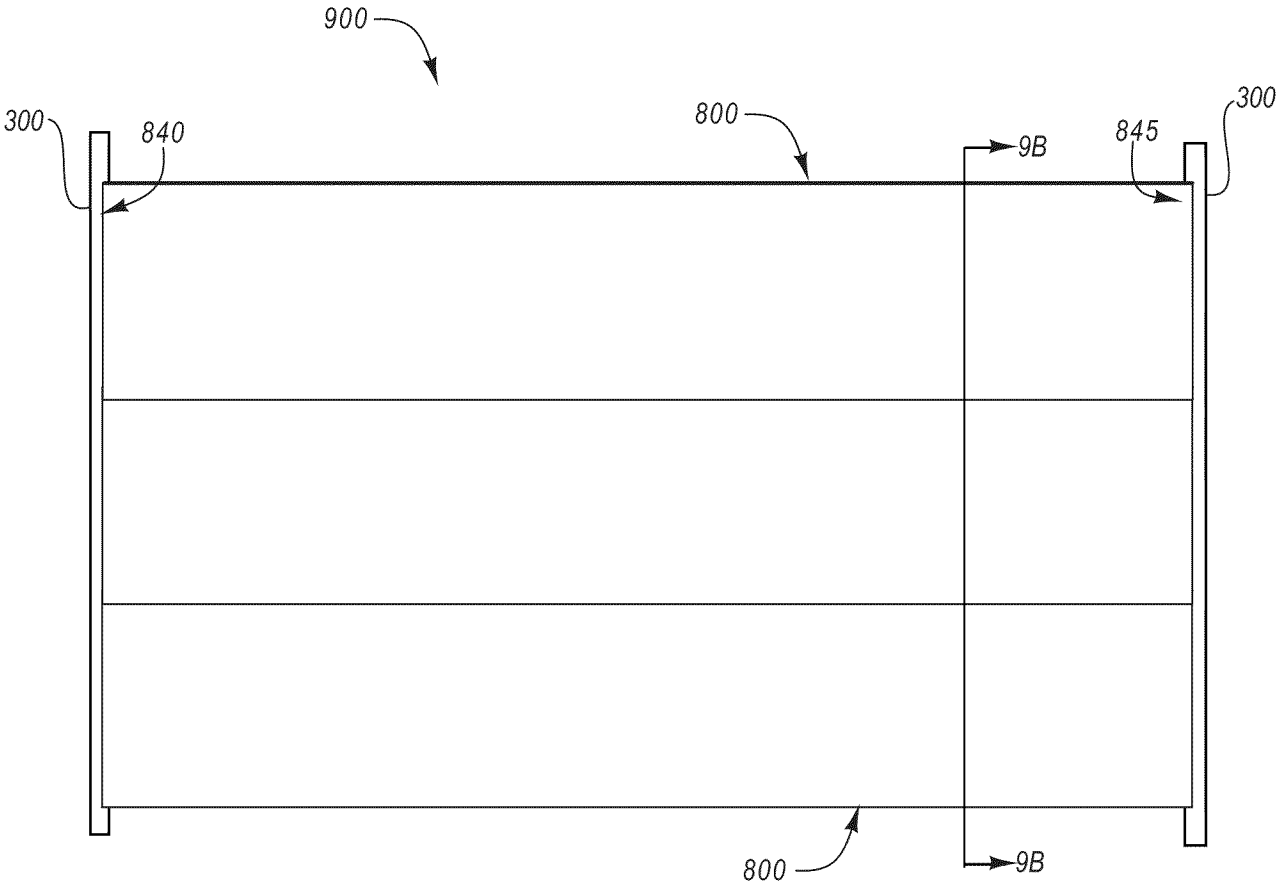
FIG. 9A illustrates a top plan view of an exemplary embodiment of a pre-cast structural floor system.
Figure 9B:
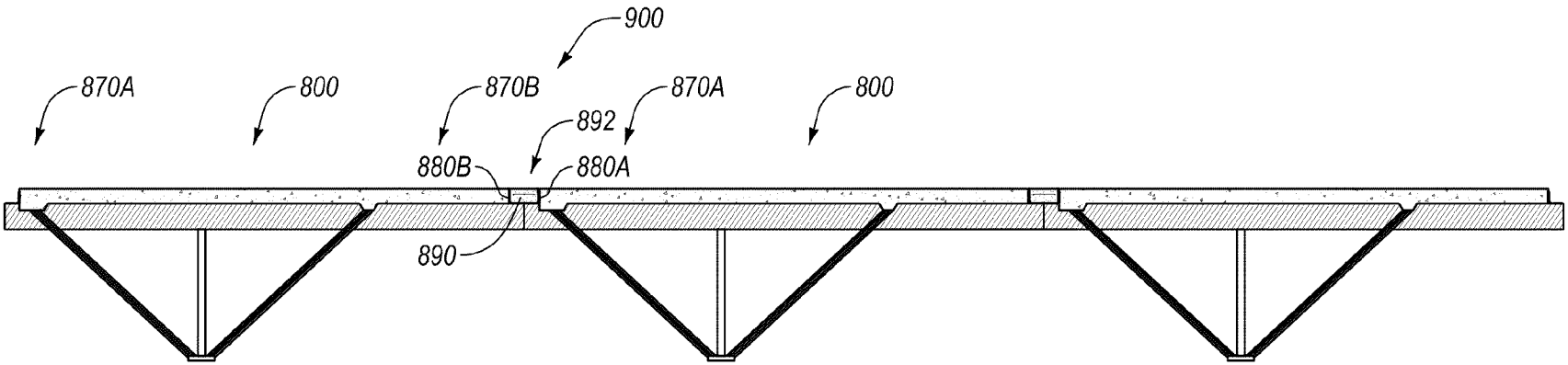
FIG. 9B illustrates a cross sectional view of the pre-cast structural floor system taken along section 9B-9B of FIG. 9A.

FIGS. 9A and 9B illustrate a precast structural floor system 900. In particular, FIG. 9A illustrates a top view of a precast structural floor system 900 while FIG. 9B illustrates a cross sectional view of the pre-cast structural floor system taken along section 9B-9B of FIG. 9A. In order to form the pre-cast structural floor system 900, girders 300 are placed at appropriate positions. One such example is shown in FIG. 9A in which girders 300 similar to those described above with reference to FIGS. 1A-1B have been provided. It will be appreciated that other girder configurations can also be used. As previously discussed, the composite floor panels 800 can include girder connection plates 846-849, 851-852 (best seen in FIGS. 8A and 8B) that are positioned beneath end edges 840, 845. The girder connection plates 846-849, 851-852 are secured to the rest of the frame assembly (FIG. 8A) in such a manner that allows the frame assembly 805 (FIG. 8A) to counter the tensile forces that would otherwise act on the end edges 840, 845 of the concrete portion 810. By directing the tensile forces to metallic portions of the composite floor panel, the composite floor panel 800 can thus be placed directly on the girders 300.

Accordingly, as shown in FIG. 9A, the end edges 840, 845 are overlappingly placed directly on the girders 300. Such a configuration can allow the composite floor panel 800 to be easily set onto the top of the girders 300. This in turn can allow for a crane to set the composite floor panels 800 quickly as each composite floor panel 800 can be positioned over the girders 300 and be lowered into place since the girder connection plates 846-849, 851-852 will engage the girders 300 directly while the rest of the composite floor panel 800 is positioned in the space between the girders 300.

FIG. 9B illustrates cross sectional view of the precast structural floor system 900 taken along section 9B-9B of FIG. 9A. As shown in FIG. 9B, various other components can allow the precast floor system 900 to be readily assembled. As shown in FIG. 9B, several composite floor panels 800 can be positioned next to each other such that the second lateral portion 870B of one composite floor panel 800 is mated to the first lateral portion 870A of an adjacent composite floor panel 800. The composite floor panels 800 can then be connected in any suitable manner.

In particular, the edge angles 880A, 880B may be secured together in any suitable manner, including those described above. Binder material 890 may then be introduced between the edge angles 880A, 880B to form a joint 892. Further, though not illustrated in FIG. 9B, any number of reinforcing members, such as rebar, bent rebar, wire mesh, shear studs, and other reinforcing members can be embedded within the concrete portion 810 and/or the edge angles 880A, 880B to reinforce the concrete portion 810 and/or the joint 892.

Figure 10:
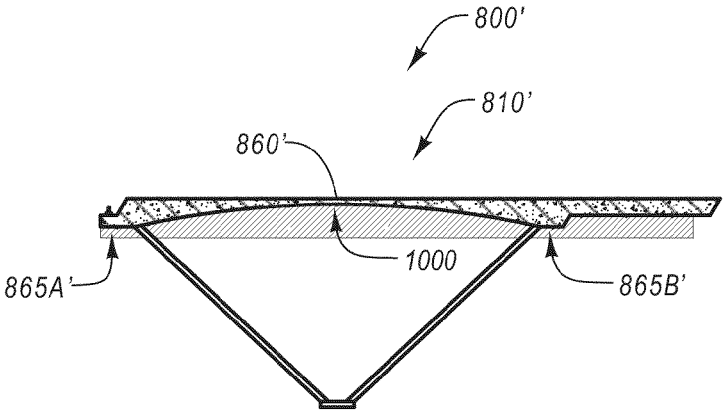
FIG. 10 illustrates an alternative embodiment of a composite floor panel.

FIG. 10 illustrates an end view of a composite floor panel 800' according to one example that includes a concrete portion 810' having an alternative configuration. In the example shown in FIG. 10, girder connection plates and end supports have been omitted to focus on the shape of the concrete portion 810', though it will be appreciate that such components can be included as part of the composite floor panel 800'.

Accordingly, the composite floor panel 800' can be similar to the composite floor panel 800 described above except that an arch 1000 is formed in the concrete slab 860' between first and second beam portions 865A', 865B'. Such a configuration can provide a smooth transition between the first and second beam portions 865A', 865B', which can reduce stress risers within the concrete slab 860' by reducing sharp corners.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A composite girder, comprising:

a precast concrete stem wall;

a flange beam coupled to a lower portion of the concrete stem wall; and a saddle secured to the flange beam, the saddle having opposing generally vertical side plates and a bottom plate fastened to and extending between the side plates, the side plates and the bottom plate extending laterally from the flange beam, the saddle forming a recess defined therein configured to receive at least a portion of a floor panel therein.

2. The composite girder of claim 1, wherein a steel beam portion of a floor panel is received between the opposing side plates and is supported by the bottom plate.

3. The composite girder of claim 2, wherein the floor panel comprises a concrete floor deck and said steel beam extending below the floor deck.

4. The composite girder of claim 1, wherein the flange beam includes a lower flange and a web secured to the lower flange and wherein the opposing side plates are secured to at least one of said lower flange and said web.

5. The composite girder of claim 1, further comprising a girder joint plate coupled to at least one of said concrete stem wall and said flange beam, said girder joint plate being configured to be secured to a panel joint plate coupled to the floor panel.

6. The composite girder of claim 5, wherein said girder joint plate is anchored to said concrete stem wall.

7. The composite girder of claim 3, wherein said concrete stem wall further includes an upper portion, and wherein said upper portion has a binder material placed thereon to form a joint between the concrete floor deck of the floor panel and said concrete stem wall.

8. A precast structural floor system, comprising:

a composite floor panel having a concrete floor deck and a steel panel beam extending below the floor deck; and a composite girder having a precast concrete stem wall, a flange beam secured to the concrete stem wall, and a saddle which includes generally vertical side plates and a bottom plate attached to and extending between the side plates secured to the flange beam such that the side plates and the bottom plate extend laterally from the flange beam, and wherein the saddle receives at least a portion of the steel panel beam therein.

9. The precast structural floor system of claim 8, wherein a portion of the steel panel beam is received between the saddle side plates and is supported by the bottom plate.

10. The precast structural floor system of claim 9, wherein a lower flange of the steel panel beam is fastened to the bottom plate of the saddle.

11. The precast structural floor system of claim 8, further comprising a girder joint plate anchored to the concrete stem wall of the composite girder and a panel joint plate anchored to the concrete stem wall of the composite floor panel, wherein the panel joint plate is configured to be fastened to the girder joint plate.

12. The precast structural floor system of claim 8, wherein the composite floor panel further include an edge member coupled to the composite floor panel, wherein the composite floor system further comprises a binder material applied over the edge member and the concrete stem wall of the composite girder.

13. A method of forming a precast structural floor system, comprising:

precasting a composite floor panel having a steel panel beam;

precasting a composite girder beam having a flange beam;

securing a saddle to the flange beam, the saddle defining a recess therein configured to receive at least a portion of the steel panel beam; and forming a joint between the composite floor panel and the composite girder beam, wherein forming the joint includes placing at least a portion of the steel panel beam into the saddle.

14. The method of claim 13, wherein precasting the composite floor panel includes precasting a concrete floor slab having an edge angle secured to the concrete floor slab, wherein precasting the composite girder includes precasting a concrete stem wall, and wherein forming the joint includes applying a binder material to the edge angle and an upper portion of the concrete stem wall of the composite girder to join the concrete floor slab to the concrete stem wall.

15. The method of claim 14, wherein the binder material includes a high-strength grout.

16. The method of claim 14, further comprising embedding reinforcements in the binder material.

17. The method of claim 14, further comprising securing reinforcements to the edge angle prior to applying the binder material.

18. The method of claim 17, wherein the reinforcements include at least one of rebar or shear studs.

19. A method of forming a precast structural floor system, comprising:

precasting a composite floor panel having a concrete portion and a panel joint plate anchored to the concrete portion;

precasting a composite girder having a flange beam, a precast concrete stem wall attached to the top of the flange beam, and a girder joint plate anchored to the concrete stem wall;

attaching a saddle to the flange beam such that the saddle extends laterally from the flange beam;

placing a portion of the precast floor panel in the saddle; and securing the panel joint plate to the girder joint plate to form a joint.

20. The method of claim 19, wherein the panel joint plate is anchored to a stem wall of the concrete portion of the composite floor panel.

21. The method of claim 19, wherein the saddle has a recess defined therein, and wherein the method further comprises placing at least a portion of a steel panel beam associated with the composite floor panel within the recess.

22. The method of claim 21, further comprising fastening the steel panel beam to the saddle.

23. The method of claim 19, further comprising applying a binder material to an intersection of the concrete portion of the composite panel and the concrete stem wall of the composite girder.

24. The method of claim 19, wherein the composite floor panel further includes an edge angle coupled to the first end and wherein placing the binder material to an intersection of the concrete portion of the composite panel includes applying a binder material over the edge angle and the concrete stem portion of the concrete stem wall of the composite girder.

* * * * *